US010004296B2

(12) United States Patent
Zadnik

(10) Patent No.: US 10,004,296 B2
(45) Date of Patent: Jun. 26, 2018

(54) ARTICLE OF FOOTWEAR WITH A FASTENING SYSTEM

(71) Applicant: NIKE, Inc., Beaverton, OR (US)

(72) Inventor: Miaochang Zadnik, Hillsboro, OR (US)

(73) Assignee: NIKE, Inc., Beaverton, OR (US)

( * ) Notice: Subject to any disclaimer, the term of this patent is extended or adjusted under 35 U.S.C. 154(b) by 38 days.

(21) Appl. No.: 14/642,396

(22) Filed: Mar. 9, 2015

(65) Prior Publication Data

US 2016/0270484 A1 Sep. 22, 2016

(51) Int. Cl.

| | |
|---|---|
| ***A43C 11/00*** | (2006.01) |
| ***A43C 11/14*** | (2006.01) |
| ***A43B 3/06*** | (2006.01) |
| ***A43B 23/07*** | (2006.01) |
| ***A43C 1/06*** | (2006.01) |
| *A43B 23/02* | (2006.01) |

(52) U.S. Cl.

CPC ..... *A43C 11/1493* (2013.01); *A43B 3/06* (2013.01); *A43B 23/024* (2013.01); *A43B 23/0205* (2013.01); *A43B 23/0235* (2013.01); *A43B 23/07* (2013.01); *A43C 1/06* (2013.01); *A43C 11/00* (2013.01); *A43B 23/02* (2013.01)

(58) Field of Classification Search

CPC ..... A43C 11/1493; A43C 1/04; A43C 1/06; A43C 11/008; A43C 11/14; A43C 11/1406; A43C 11/1413; A43C 11/142; A43C 11/1426; A43C 11/1453; A43B 23/0205; A43B 7/1495

USPC ..... 36/50.1

See application file for complete search history.

(56) References Cited

U.S. PATENT DOCUMENTS

| | | | | | |
|---|---|---|---|---|---|
| 2,096,160 | A | * | 10/1937 | Chambers | A43B 7/1495 36/170 |
| 2,660,812 | A | * | 12/1953 | Henke | A43B 5/0486 36/1.5 |
| 4,005,533 | A | * | 2/1977 | Anderson | A43C 15/065 36/62 |
| 4,513,520 | A | * | 4/1985 | Koch | A43B 5/0405 36/10 |
| 4,547,981 | A | * | 10/1985 | Thais | A43B 7/00 36/114 |
| 4,922,630 | A | | 5/1990 | Robinson | |
| 4,972,613 | A | * | 11/1990 | Loveder | A43B 5/00 36/105 |
| 5,016,623 | A | | 5/1991 | Krahenbuhl | |
| 5,269,078 | A | * | 12/1993 | Cochrane | A43B 5/00 36/170 |
| 5,408,761 | A | | 4/1995 | Gazzano | |

(Continued)

FOREIGN PATENT DOCUMENTS

DE 4034897 A1 5/1992

OTHER PUBLICATIONS

International Search Report and Written Opinion dated May 9, 2016 in PCT Application No. PCT/US2015/066919.

*Primary Examiner* — Katharine Gracz

(74) *Attorney, Agent, or Firm* — Klarquist Sparkman, LLP

(57) ABSTRACT

An article of footwear including a fastening system is disclosed. The fastening system is adjustable and includes portions that can be directly attached to the article. The article can include elements that are capable of distributing tension over the article. The article may include a fastener and one or more tensile elements.

24 Claims, 11 Drawing Sheets

(56) References Cited

U.S. PATENT DOCUMENTS 5,425,185 A * 6/1995 Gansler ..... A43C 11/165 36/50.1
5,469,640 A * 11/1995 Nichols ..... A43C 1/00 24/306
5,659,982 A * 8/1997 Muraoka ..... A43B 3/0073 36/131
5,701,689 A * 12/1997 Hansen ..... A43B 7/20 36/115
5,771,608 A * 6/1998 Peterson ..... A43B 5/00 36/50.1
5,775,006 A * 7/1998 Breuner ..... A43B 3/02 36/45
5,836,094 A * 11/1998 Figel ..... A43B 3/0073 36/131
5,992,057 A * 11/1999 Monti ..... A43B 5/02 36/50.1
6,324,773 B1 12/2001 Gaither
6,505,424 B2 * 1/2003 Oorei ..... A43B 5/00 36/129
6,602,214 B2 * 8/2003 Heinz ..... A61F 5/03 128/99.1
6,792,702 B2 * 9/2004 Borsoi ..... A43B 5/0401 36/117.6
D656,715 S 4/2012 Katz et al.
8,302,329 B2 11/2012 Hurd et al.
8,387,282 B2 * 3/2013 Baker ..... A43C 11/008 36/133
8,857,077 B2 * 10/2014 Kahatsu ..... A43B 3/26 36/113
2007/0033836 A1 2/2007 Rasmussen
2008/0028641 A1 * 2/2008 Messmer ..... A43B 5/0401 36/117.7
2011/0088285 A1 * 4/2011 Dojan ..... A43B 1/04 36/87
2011/0258876 A1 * 10/2011 Baker ..... A43C 11/008 36/50.1
2011/0308110 A1 12/2011 Berns et al.
2012/0079741 A1 * 4/2012 Kohatsu ..... A43B 3/26 36/50.1
2013/0152424 A1 * 6/2013 Dojan ..... A43B 23/0225 36/83
2013/0160328 A1 * 6/2013 Hatfield ..... A43B 23/02 36/103
2013/0255105 A1 10/2013 Bishop et al.

* cited by examiner

ARTICLE OF FOOTWEAR WITH A FASTENING SYSTEM

BACKGROUND

The present embodiments relate generally to articles of footwear, and in particular to articles of footwear for sports.

Articles of footwear generally include two primary elements: an upper and a sole structure. The upper may be formed from a variety of materials that are stitched or adhesively bonded together to form a void within the footwear for comfortably and securely receiving a foot. The sole structure is secured to a lower portion of the upper and is generally positioned between the foot and the ground. In many articles of footwear, including athletic footwear styles, the sole structure often incorporates an insole, a midsole, and an outsole.

SUMMARY

In one aspect, the present disclosure is directed to an article of footwear, the article of footwear comprising an upper, wherein the upper includes an outermost surface, and the upper further includes an inner liner and an outer liner. The article of footwear also includes a fastening system, where the fastening system has a fastener, at least two tensile elements, and a receptacle. At least a portion of the at least two tensile elements are disposed between the inner liner and the outer liner, and at least two tensile elements are joined to the receptacle. In addition, the fastener is disposed proximate the outermost surface, and the fastener engages with the receptacle.

In another aspect, the present disclosure is directed to an article of footwear, the article of footwear comprising a base axis, a first diagonal axis, and a second diagonal axis, where the base axis, the first diagonal axis, and the second diagonal axis are nonparallel, and where the base axis extends from one side of the article of footwear to an opposing side of the article of footwear. The article of footwear also includes an upper and a fastening system, and the fastening system includes a fastener, a first receptacle, and one or more tensile elements, where the one or more tensile elements include a first tensile element. The upper also comprises a first portion and a second portion, where the first tensile element is disposed along the first portion, and where the first tensile element is substantially aligned with the second diagonal axis. The fastener and the first tensile element are each joined to the first receptacle. The fastening system includes a secured state and an unsecured state, where a first portion of the fastener is disposed along the first portion of the upper in the secured state, where the first portion of the fastener is substantially aligned with the first diagonal axis. In addition, a second portion of the fastener is disposed along the second portion of the upper in the secured state, where the second portion of the fastener is substantially aligned with the base axis. The fastening system is configured to distribute a compressive tension over at least a portion of the second portion of the upper and at least a portion of the first portion of the upper when the fastening system is in the secured state.

In another aspect, the present disclosure is directed to an article of footwear, the article of footwear comprising an upper, a fastener, a receptacle, and one or more tensile elements. The upper includes a base axis, a first diagonal axis, and a second diagonal axis, where the base axis, the first diagonal axis, and the second diagonal axis are nonparallel. Further, the upper includes a forefoot portion, a vamp portion and an instep portion. The upper has an open state and a closed state, and the fastener has a first portion, a second portion, and a third portion. The first portion is fixedly attached to the vamp portion of the upper, where the second portion and the third portion are unattached to the upper. The first portion is aligned along the first diagonal axis, the second portion is configured to align with the first diagonal axis and the third portion is configured to align with the base axis in the closed state. In addition, the first portion of the fastener is disposed nearer to the forefoot portion relative to the second portion and the third portion in the closed state. The receptacle is disposed along the instep portion, where the receptacle is configured to engage with the third portion of the fastener The one or more tensile elements each comprise a first region and a second region, where the first region is fixedly attached to the vamp portion of the upper, and the second region is unattached to the upper. The one or more tensile elements are each aligned along the second diagonal axis, and the second region of each of the one or more tensile elements are joined to the receptacle. Furthermore, the first region of each of the one or more tensile elements are disposed nearer to the forefoot portion relative to the second region of each of the one or more tensile elements.

Other systems, methods, features and advantages of the embodiments will be, or will become, apparent to one of ordinary skill in the art upon examination of the following figures and detailed description. It is intended that all such additional systems, methods, features and advantages be included within this description and this summary, be within the scope of the embodiments, and be protected by the following claims.

BRIEF DESCRIPTION OF THE DRAWINGS

The embodiments can be better understood with reference to the following drawings and description. The components in the figures are not necessarily to scale; emphasis is instead being placed upon illustrating the principles of the embodiments. Moreover, in the figures, like reference numerals designate corresponding parts throughout the different views.

DETAILED DESCRIPTION

Figure 1:
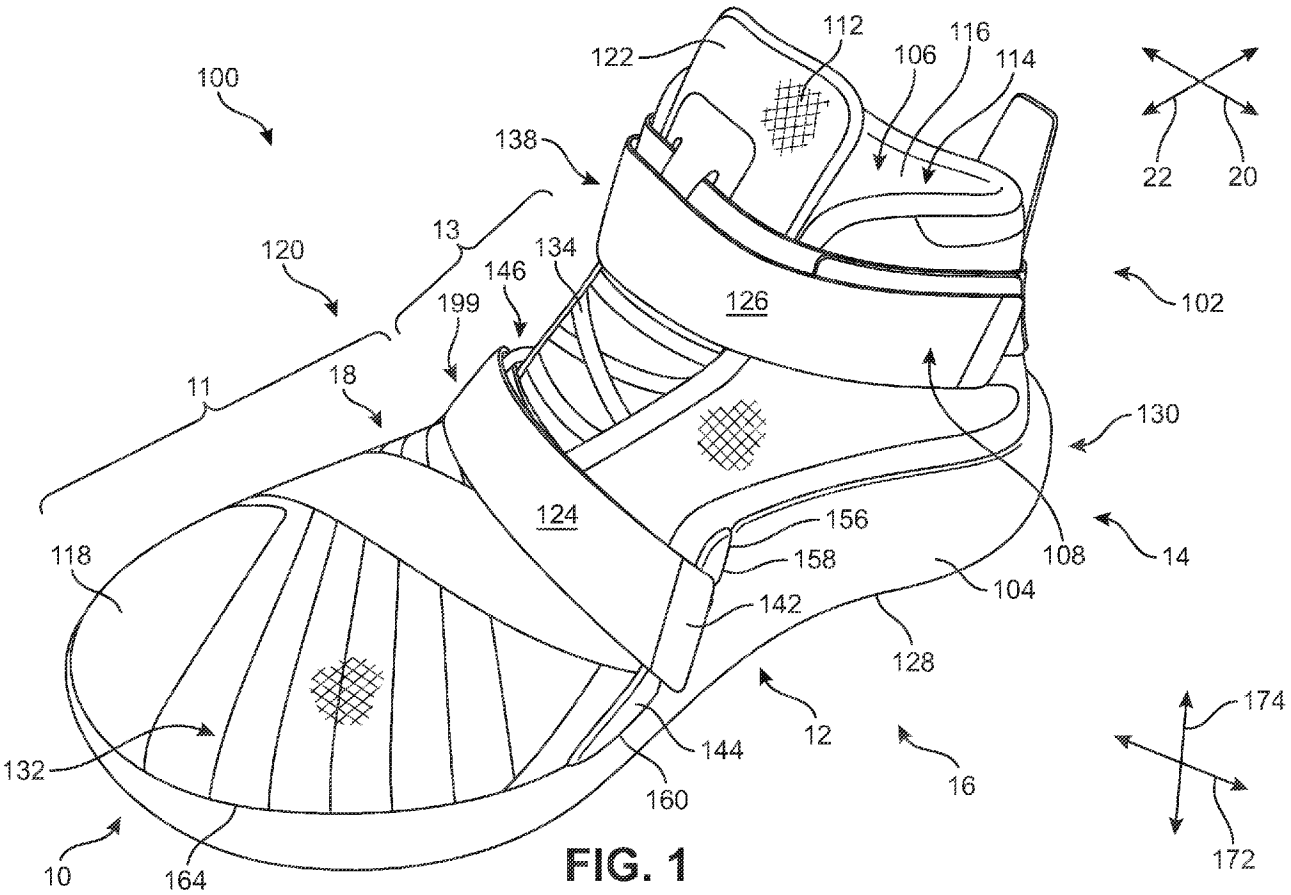
FIG. 1 is a schematic isometric view of an embodiment of an article of footwear including an upper and a sole structure.
Figure 2:
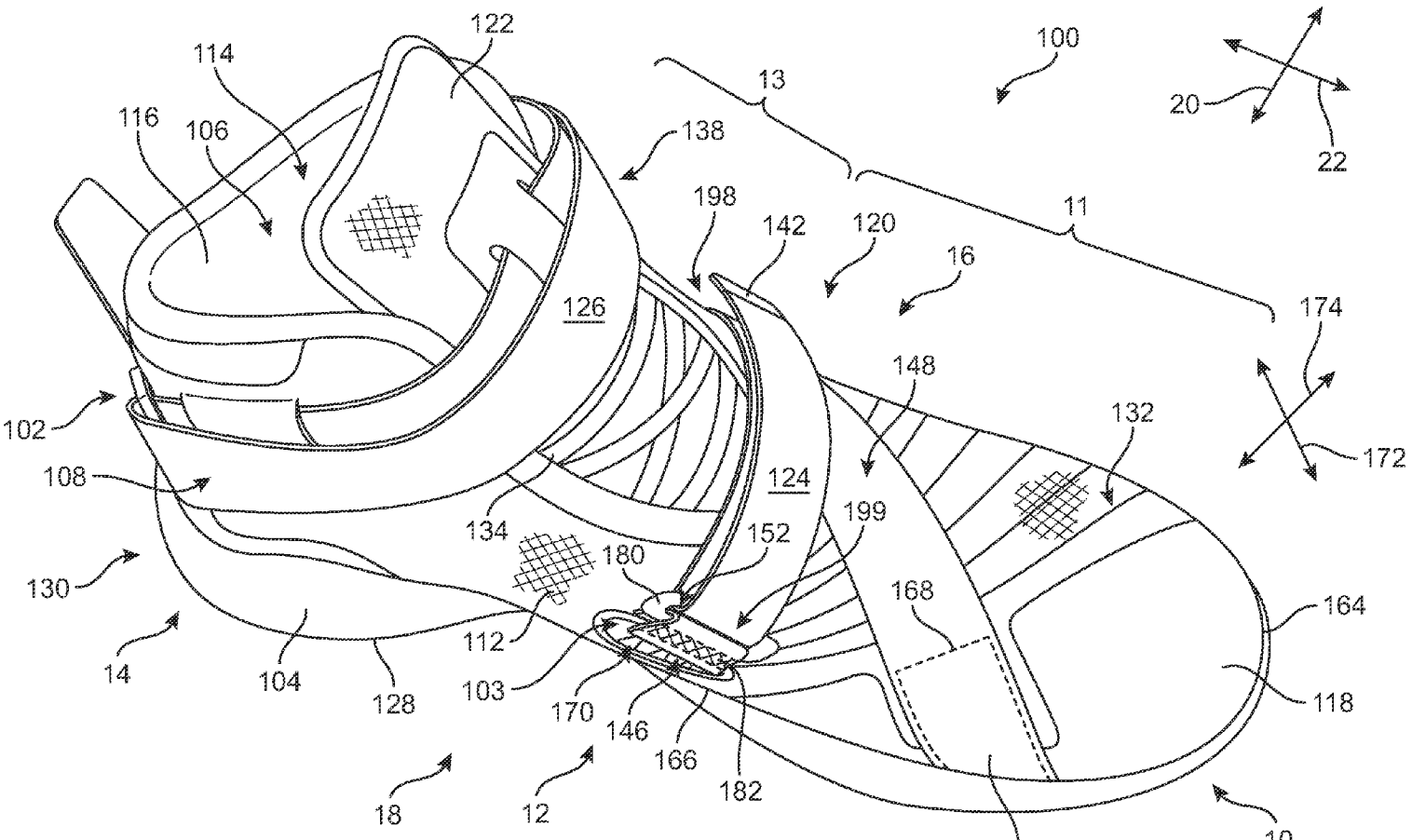
FIG. 2 is a schematic isometric view of an embodiment of an article of footwear including an upper and a sole structure.
Figure 3:
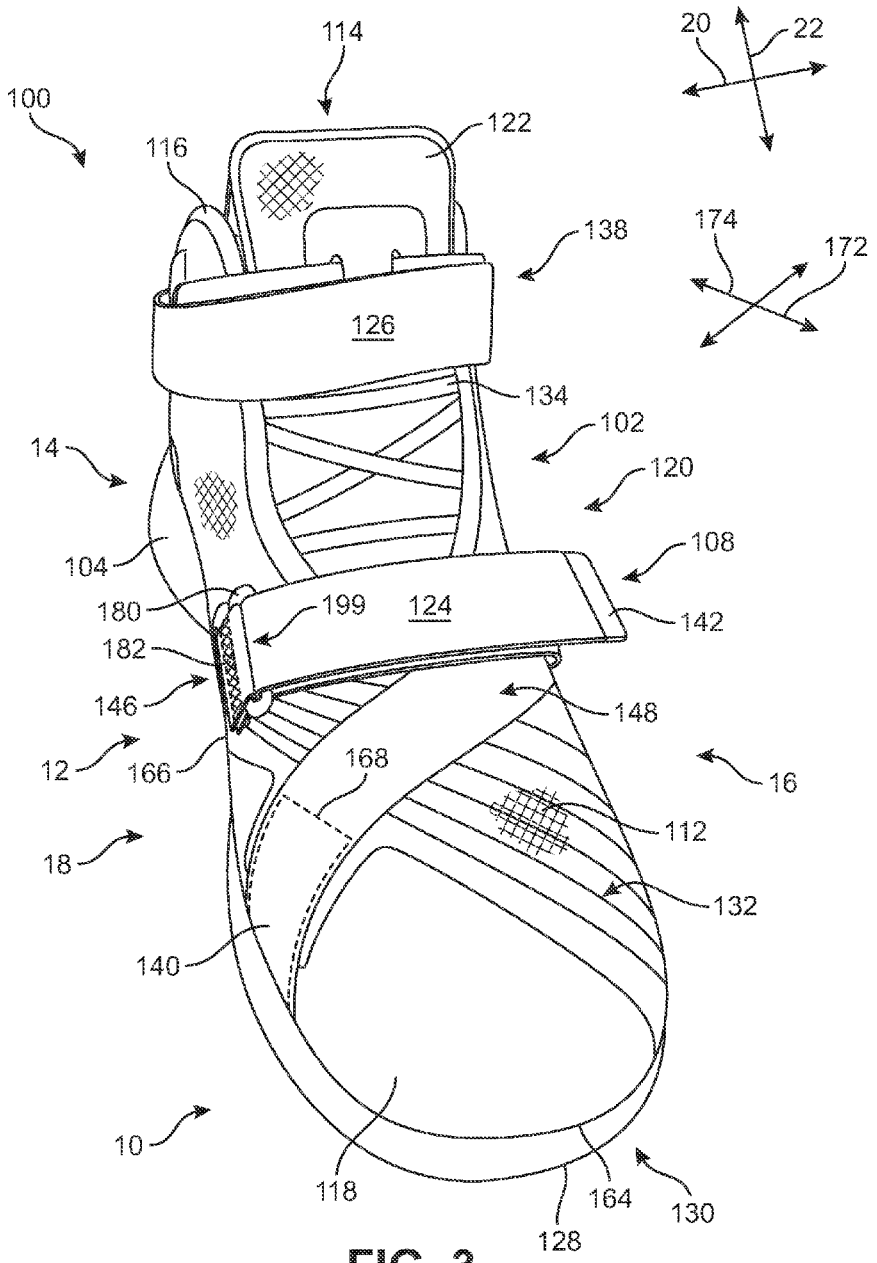
FIG. 3 is a schematic isometric view of an embodiment of an article of footwear including an upper and a sole structure.

FIGS. 1-3 depict isometric views of an embodiment of an article of footwear 100. In one embodiment, article of footwear 100 has the form of an athletic shoe. The provisions discussed herein for article of footwear 100 could be incorporated into various other kinds of footwear including, but not limited to, basketball shoes, hiking boots, soccer shoes, football shoes, sneakers, running shoes, cross-training shoes, rugby shoes, rowing shoes, baseball shoes as well as other kinds of shoes. Moreover, in some embodiments, the provisions discussed herein for article of footwear 100 could be incorporated into various other kinds of non-sports-related footwear, including, but not limited to, slippers, sandals, high heeled footwear, and loafers.

For purposes of clarity, the following detailed description discusses the features of article of footwear 100, also referred to simply as article 100. However, it will be understood that other embodiments may incorporate a corresponding article of footwear (e.g., a right article of footwear when article 100 is a left article of footwear) that may share some, and possibly all, of the features of article 100 described herein and shown in the figures.

The embodiments may be characterized by various directional adjectives and reference portions. These directions and reference portions may facilitate in describing the portions of an article of footwear. Moreover, these directions and reference portions may also be used in describing sub-components of an article of footwear (e.g., directions and/or portions of a midsole structure, an outer sole structure, a fastening system, an upper or any other components).

For consistency and convenience, directional adjectives are employed throughout this detailed description corresponding to the illustrated embodiments. The term "longitudinal" as used throughout this detailed description and in the claims refers to a direction or axis extending a length of a component (e.g., an upper or sole component). In some embodiments, a longitudinal direction may extend from a forefoot portion to a heel portion of the component. Also, the term "lateral" as used throughout this detailed description and in the claims refers to a direction or axis extending along a width of a component. For example, a lateral direction may extend between a medial side and a lateral side of a component. Furthermore, the term "vertical" as used throughout this detailed description and in the claims refers to a direction or axis generally perpendicular to a lateral and longitudinal direction. For example, in embodiments where an article is planted flat on a ground surface, a vertical direction may extend from the ground surface upward. Additionally, the term "inner" refers to a portion of an article disposed closer to an interior of an article, or closer to a foot when the article is worn. Likewise, the term "outer" refers to a portion of an article disposed further from the interior of the article or from the foot. Thus, for example, the inner surface of a component is disposed closer to an interior of the article than the outer surface of the component. Furthermore, the term "beneath" refers to a relative position closer toward the ground, a sole structure, and/or an interior cavity of the article of footwear. The term "above" refers to a relative position that is opposite to beneath. This detailed description makes use of these directional adjectives in describing an article and various components of the article, including an upper, a midsole structure and/or an outer sole structure.

Article 100 may be characterized by a number of different regions or portions. For example, article 100 could include a forefoot portion, a midfoot portion, a heel portion, a vamp portion, and an instep portion. Moreover, components of article 100 could likewise comprise corresponding portions. Referring to FIG. 1, article 100 may be divided into forefoot portion 10, midfoot portion 12 and heel portion 14. Forefoot portion 10 may be generally associated with the toes and joints connecting the metatarsals with the phalanges. Midfoot portion 12 may be generally associated with the arch of a foot. Likewise, heel portion 14 may be generally associated with the heel of a foot, including the calcaneus bone. Article 100 may also include a vamp portion 11, and an instep portion 13. Vamp portion 11 may be generally associated with the front and middle part of a shoe upper that covers the part of the foot adjacent to the toes. Furthermore, instep portion 13 may be generally associated with the upper, center section of the foot, between the toes and ankle, adjacent to vamp portion 11. Generally, article 100 may also include an ankle portion that is associated with the rear portion of an article of footwear, including the region around the opening providing access to the interior of the shoe.

In addition, article 100 may include a lateral side 16 and a medial side 18. In particular, lateral side 16 and medial side 18 may be opposing sides of article 100. Furthermore, both lateral side 16 and medial side 18 may extend through forefoot portion 10, midfoot portion 12, heel portion 14, vamp portion 11, and instep portion 13.

FIGS. 1-3 illustrate various features and components of article of footwear 100, including an upper 102 and a sole structure 130. FIG. 1 provides an isometric lateral view of an embodiment of article 100. FIG. 2 provides an isometric medial view of an embodiment of article 100. FIG. 3 provides an isometric front view of an embodiment of article 100. Depending on the material of upper 102, in some embodiments, upper 102 may be configured to stretch fit over a foot without the need for additional fasteners. However, in other embodiments, the use of one or more fasteners 108 may allow upper 102 to enlarge or tighten over a foot and/or provide the needed amount of tension to keep article 100 on the foot. Some embodiments of a fastening system will be discussed further below.

Furthermore, in some embodiments, sole structure 130 may be configured to provide traction for article 100. Thus, in different embodiments, traction elements may be included in sole structure 130. In addition to providing traction, sole structure 130 may attenuate ground reaction forces when compressed between the foot and the ground during walking, running, pushing, or other ambulatory activities. The configuration of sole structure 130 may vary significantly in different embodiments to include a variety of conventional or nonconventional structures. In some embodiments, the configuration of sole structure 130 can be configured according to one or more types of surfaces on which sole structure 130 may be used. Examples of surfaces include, but are not limited to, natural turf, synthetic turf, dirt, hardwood flooring, skims, wood, plates, footboards, boat ramps, as well as other surfaces.

The various portions of sole structure 130 may be formed from a variety of materials. For example, sole structure 130 may include a compressible polymer foam element (e.g., a polyurethane or ethylvinylacetate foam) that attenuates ground reaction forces (i.e., provides cushioning) when compressed between the foot and the ground during walking, running, or other ambulatory activities. In further configurations, sole structure 130 may incorporate fluid-filled chambers, plates, moderators, or other elements that further attenuate forces, enhance stability, or influence the motions of the foot. Furthermore, other portions of sole structure 130, such as an outsole 128, can be formed from a wear-resistant rubber material that is textured to impart traction. It should be understood that the embodiments herein depict a configuration for sole structure 130 as an example of a sole structure that may be used in connection with upper 102, and a variety of other conventional or nonconventional configurations for sole structure 130 may also be utilized. Accordingly, the structure and features of sole structure 130 or any sole structure utilized with upper 102 may vary considerably.

Sole structure 130 is secured to upper 102 and extends between a foot and the ground when article 100 is worn. In different embodiments, sole structure 130 may include different components. For example, sole structure 130 may include outsole 128. Sole structure 130 may further include a midsole and/or an insole. In some embodiments, one or more of these components may be optional. In addition, sole structure 130 may include components or portions that extend toward and/or attach to a portion of upper 102. Such components may provide additional support and compressive strength to article 100. For example, a reinforcing member 104 may extend along or be disposed adjacent to a portion of lateral side 16 or medial side 18 of upper 102. In some embodiments, reinforcing member 104 may extend along or be disposed adjacent to various portions of upper 102. In FIGS. 1-3, reinforcing member 104 is integrally joined to sole structure 130 and is also disposed adjacent to upper 102. In one embodiment, reinforcing member 104 may extend or surround portions of heel portion 14 and/or midfoot portion 12. In other embodiments, reinforcing member 104 may extend from outsole 128 to a portion of upper 102. Reinforcing member 104 can also be used to anchor or fortify various elements or areas of article 100 in different embodiments. For example, in one embodiment, a portion of reinforcing member 104 can act as a heel counter. While reinforcing member 104 may be substantially smooth in some embodiments, in other embodiments, reinforcing member 104 may include regions with increased curvature, dimpling, protrusions, insignia, or other structural formations.

In different embodiments, upper 102 may be joined to sole structure 130 and define an interior cavity 106 designed to receiver a wearer's foot. In some embodiments, upper 102 includes a mouth 114 that provides access for the foot into interior cavity 106 of upper 102. Mouth 114 may be disposed along or near the ankle portion in some embodiments. Furthermore, in some embodiments, a lace 134 can extend through various apertures or other securing elements and permit the wearer to modify dimensions of upper 102 to accommodate the proportions of the foot. More particularly, lace 134 may permit the wearer to tighten portions of upper 102 around the foot, and lace 134 can permit the wearer to loosen upper 102 to facilitate entry and removal of the foot from mouth 114. In alternative embodiments, upper 102 may include other lace-receiving elements, such as loops, eyelets, and D-rings. In addition, upper 102 includes a tongue 122 that extends between interior cavity 106 and lace 134.

Upper 102 may generally incorporate various provisions associated with uppers. Upper 102 may also be characterized by one or more layers disposed adjacent to one another. In some embodiments, each layer of upper 102 can be configured to provide various degrees of cushioning, tension, ventilation, shock absorption, energy return, support, as well as possibly other provisions.

For example, in some embodiments, upper 102 may include a base layer, an inner liner or layer, an outer liner or layer, and/or a protective layer. Referring to FIGS. 1-3, in one embodiment, article 100 includes a base layer 116, an inner liner (shown in the exploded view of FIG. 8), an outer liner 112, and a protective layer 118. Base layer 116 may be disposed closest to a foot when article 100 is worn by a user. In some embodiments, base layer 116 can serve as a sock-liner or a bootie. In another embodiment, base layer 116 can comprise the most rigid portion of upper 102. In one embodiment, base layer 116 has a greater thickness than other layers of upper 102.

In addition, upper 102 may include an inner liner (see inner liner 800 in FIG. 8) that is disposed along the outer surface of base layer 116. The inner liner can be disposed further away from interior cavity 106 than base layer 116. The inner liner can extend over only some portions of base layer 116 in some embodiments, or the inner liner can be disposed such that it covers substantially all of the outer or exterior surface of base layer 116. The inner liner may also be disposed along the exterior surface of tongue 122 in some embodiments. It should be understood that in other embodiments, article 100 may not include an inner liner.

In some embodiments, upper 102 may also include outer liner 112, which may comprise at least a portion of the outer or exposed surface of upper 102. Thus, outer liner 112 can be disposed further away from interior cavity 106 than base layer 116 and/or the inner liner. In one embodiment, outer liner 112 may be disposed directly over the surface of the inner liner. In embodiments where upper 102 does not include an inner liner, outer liner 112 may be disposed directly adjacent to or over base layer 116. Furthermore, in some embodiments, outer liner 112 may also be disposed along at least some of tongue 122. In other embodiments, outer liner 112 can extend over only some portions of base layer 116. In some embodiments, outer liner 112 can be disposed such that it covers substantially all of the exterior surface of the inner liner. In addition, in one embodiment, outer liner 112 may at least partially comprise the outermost layer (i.e., the most exterior layer, and/or the layer disposed furthest from interior cavity 106) of upper 102. In some embodiments, outer liner 112 may include a mesh material, or otherwise include perforations that expose areas beneath outer liner 112 (e.g., portions of the fastening system, tongue 122, the inner liner, base layer 116, and/or lacing system). It should be understood that in some embodiments, article 100 may not include outer liner 112.

Furthermore, in some embodiments, upper 102 includes a protective layer 118. Protective layer 118 may comprise at least a portion of the outer or exposed surface of upper 102. In some embodiments, protective layer 118 may be disposed over or joined to portions of outer liner 112. For example, in FIGS. 1-3, protective layer 118 is disposed along vamp portion 13. Protective layer 118 may also disposed be adjacent to reinforcing member 104 along forefoot portion 10, midfoot portion 12, and heel portion 14 of upper 102. Protective layer 118 can also be seen around the edges of outer liner 112 bordering tongue 122. Protective layer 118 may be included in regions of article 100 where additional structural support is desired. In embodiments where outer liner 112 includes perforations, protective layer 118 may cover the perforations. In some embodiments, protective layer 118 has a greater stiffness than outer liner 112, though in other embodiments, the stiffness of outer liner 112 may be greater or substantially similar to the stiffness of protective layer 118. In one embodiment, protective layer 118 may be substantially water-resistant. It should be understood that in some embodiments, article 100 may not include protective layer 118. Furthermore, in some embodiments, portions of protective layer 118 may be either substantially opaque, translucent, or generally clear (i.e., transparent).

In different embodiments, each of the materials that may comprise the layer(s) of upper 102 can include various properties. The various portions of upper 102 may be formed from one or more of a plurality of material elements (e.g., textiles, polymer sheets, foam layers, leather, synthetic leather, knitted fabrics, etc.) that are stitched together or otherwise laid or disposed adjacent to one another to form upper 102. Other materials that could be used in various embodiments include, but are not limited to: expanded rubber, foam rubber, various kinds of foams, polyurethane, nylon, Gore-Tex, leather, plastic, textiles, as well as possibly other materials. Other parts of upper 102 may be made from any of a plurality of materials or combination of materials, such as leather, leather-like materials, polymer materials, plastic materials, and textile fabrics and materials.

In addition, each of the layers comprising upper 102 may be formed from any generally two-dimensional material. As utilized with respect to the present invention, the term "two-dimensional material" or variants thereof is intended to encompass generally flat materials exhibiting a length and a width that are substantially greater than a thickness. Accordingly, suitable materials for upper layers (e.g., base layer 116, the inner liner, outer liner 112, and/or protective layer 118) include various textiles, polymer sheets, or combinations of textiles and polymer sheets, for example. Textiles are generally manufactured from fibers, filaments, or yarns that are, for example, either (a) produced directly from webs of fibers by bonding, fusing, or interlocking to construct non-woven fabrics and felts or (b) formed through a mechanical manipulation of yarn to produce a woven or knitted fabric. The textiles may incorporate fibers that are arranged to impart one-directional stretch or multidirectional stretch, and the textiles may include coatings that form a breathable and water-resistant barrier, for example. The polymer sheets may be extruded, rolled, or otherwise formed from a polymer material to exhibit a generally flat aspect. Two-dimensional materials may also encompass laminated or otherwise layered materials that include two or more layers of textiles, polymer sheets, or combinations of textiles and polymer sheets. In addition to textiles and polymer sheets, other two-dimensional materials may be utilized for upper 102. Although two-dimensional materials may have smooth or generally untextured surfaces, some two-dimensional materials will exhibit textures or other surface characteristics, such as dimpling, protrusions, ribs, or various patterns, for example. Despite the presence of surface characteristics, two-dimensional materials remain generally flat and exhibit a length and a width that are substantially greater than a thickness. In some configurations, mesh materials or perforated materials may be utilized for upper. For example, the inner liner, outer liner 112, and/or protective layer 118 may comprise a mesh material, which may impart greater breathability or air permeability to article 100.

Referring to FIGS. 1-3, in some embodiments, article 100 can include provisions for helping to secure or fasten upper 102 and sole structure 130 to a foot. In some embodiments, article 100 includes a fastening system 120. Fastening system 120 can help article 100 assume an expanded, loose, unsecured, or open state, where the user's foot can be inserted or removed from interior cavity 106 via mouth 114, and a contracted, secured, closed, or tightened state, where the user's foot is secured within interior cavity 106.

In different embodiments, fastening system 120 could incorporate various fastening provisions including laces, tensile elements, straps, fasteners, zippers or other kinds of components that may help secure upper 102 around a foot. In some embodiments, fastening system 120 may include one or more fasteners 108, as noted above. In one embodiment, fasteners 108 may comprise an elongated strap-like component that may be wrapped around a portion of upper 102.

In the embodiment of FIGS. 1-3, fasteners 108 can include a first fastener 124. In one embodiment, first fastener 124 can be substantially strap-like. In other embodiments, there may be additional fasteners 108. For example, in one embodiment, article 100 may further include an ankle cinching system 138, which may include a second fastener 126. In some embodiments, second fastener 126 extends around or is associated with the ankle portion. Ankle cinching system 138 may allow a user to adjust the tension of upper 102 around an ankle when a foot is inserted within interior cavity 106. In other embodiments, additional fasteners 108 may be disposed along other portions of upper 102. In another embodiment, upper 102 may not include an ankle cinching system 138.

In addition, in one embodiment, fasteners 108 may include provisions for gripping or holding the fastener. As shown in FIGS. 1-3, first fastener 124 includes a pull tab 142. Pull tab 142 may be a component or material joined to an end of fasteners 108. Pull tab 142 can facilitate the adjustment of fasteners 108 by providing a gripping region a user may use to pull or move fasteners 108 in some embodiments.

For purposes of reference, first fastener 124 may be divided into a fixed portion and a free portion. As shown in FIGS. 2 and 3, fixed portion 140 is a portion of first fastener 124 disposed nearest forefoot portion 10, along medial side 18. However, in other embodiments, fixed portion 140 may be disposed elsewhere along upper 102. In some embodiments, fixed portion 140 may be disposed near one edge or one side of upper 102, adjacent to sole structure 130. Fixed portion 140 may provide greater reinforcement to fastening system 120. Further, fixed portion 140 can act as an anchoring region for fastening system 120 in some embodiments.

In some embodiments, fixed portion 140 may be joined to a part of upper 102 by one or more anchor portions. In FIGS. 2 and 3, fixed portion 140 is depicted as joined to upper 102 along an anchor portion 168. In embodiments where fixed portion 140 is joined to upper 102 at multiple locations, there may be additional anchor portions. Thus, in various embodiments, anchor portions can comprise regions where a component or portion of article 100 is joined or otherwise secured. In other words, fixed portion 140 may be fixedly attached to one or more layers of upper 102. For purposes of this description, "fixedly attached" refers to an attachment between portions of two elements or materials where the portions are intended to remain attached during use of the article. In some embodiments, this may be referred to as permanently attached. Fixedly attached may be contrasted with surfaces that are adjustable or moveable, where components or materials are intended or readily capable of moving relative to one another. The fixed attachment may be formed through sewing, stitching, fusion, bonding, glue (by an adhesive or other agents), or a combination of thereof. In some embodiments, anchor portions 168 can provides a high level of strength and stability, and can also be used to provide design or ornamental enhancements to article 100. In FIGS. 2 and 3, for example, anchor portion 168 comprises a stitched box-like pattern that extends under sole structure 130. In other embodiments, anchor portions 168 may be reinforced with an "X", a zig-zag pattern, or other types of stitching through the middle region of the stitch box. In addition, anchor portions may be used to position or direct a portion of fasteners 108 along a specific orientation. For example, in FIGS. 2 and 3, fixed portion 140 is oriented diagonally, extending from sole structure 130 at an angle toward midfoot portion 12. In one embodiment, fixed portion 140 may be generally aligned with a first diagonal axis 172. It can be seen that first diagonal axis 172 is nonparallel to both a lateral axis 20 and a longitudinal axis 22. For purposes of this reference, nonparallel refers to two axes or directions that do not extend in the exact same direction or orientation, or cases where two directions are oriented in a way that they would eventually intersect or converge. Furthermore, it should be understood that while the phrase "lateral axis" may be associated with an axis that can extend directly (i.e., in a substantially straight line) from medial side 18 to lateral side 16, in some embodiments, references to the direction associated with lateral axis 20 can more generally represent a base axis that extends from medial side 18 to lateral side 16. In other words, a reference to the lateral axis or base axis herein and in the claims can refer to an axis that may be slightly offset from an axis that extends directly across the article of footwear from medial side 18 to lateral side 16 in a straight line.

Furthermore, it should be understood that fixed portion 140 can vary in size and shape. In some embodiments, fixed portion 140 may comprise a larger or smaller proportion of first fastener 124 than depicted in FIGS. 2 and 3. Furthermore, fixed portion 140 may comprise regular or irregular shaped portions of first fastener 124.

As noted above, first fastener 124 also includes a free portion 148. For purposes of this disclosure, "free" refers to the ability of an element or material to be moved or adjusted. Thus, free portion 148 of first fastener 124 may be adjusted or otherwise moved to the extent permitted by the disposition of fixed portion 140. It can be seen that due to the orientation of fixed portion 140, free portion 148 is also generally oriented along a diagonal direction extending from forefoot portion 10 on medial side 18 toward midfoot portion 12 on lateral side 16, similar to fixed portion 140 (i.e., first diagonal axis 172). However, it should be understood that free portion 148 may also be readily bent, folded, curled, adjusted, or otherwise moved to include other orientations or positions. Free portion 148 and the operation of first fastener 124 will be discussed in further detail below with respect to FIGS. 4-7.

As shown in FIGS. 1-3, article 100 may include provisions for further securing various portions of fasteners 108 and/or fastening elements. In some embodiments, first fastener 124 may contact one or more receptacles. A receptacle may be a buckle, loop, ring, sleeve, or other element providing a region of anchoring, securement, guidance, or attachment for at least a portion of a fastener. Receptacles may be made of any material, including textiles, or more rigid materials, such as a plastic, polymer, or a metal material. In one embodiment, a portion of a receptacle may comprise a frame-like geometry. For example, a receptacle may include a border with a central aperture or gap that receives portions of fastener elements. Receptacles may be attached to article 100 through bonding, adhesives, stitching, or other means similar to anchor portions.

In the lateral isometric view of FIG. 1, it can be seen that article 100 includes a first receptacle 144 which contacts a part of first fastener 124. In FIG. 1, first receptacle 144 is disposed in a region that can include vamp portion 11 and instep portion 13, along lateral side 16 of upper 102. A portion of free portion 148 of first fastener 124 extends through first receptacle 144 in the closed or secured state of fastening system 120 depicted in FIGS. 1-3. In FIGS. 1-3, first fastener 124 is shown to further contact and/or engage with a second receptacle 146, discussed further below.

In FIG. 1, first receptacle 144 comprises a substantially elongated shape. In some embodiments, first receptacle 144 may be wider along both ends and narrower along its center. In one embodiment, the center of first receptacle 144 includes a narrow arch-shaped space. In some embodiments, first receptacle 144 is disposed adjacent to reinforcing member 104, such that they are aligned. In FIG. 1, a rear edge 156 of first receptacle 144 is joined to a forward edge 158 of reinforcing member 104. Furthermore, a lower edge 160 of first receptacle 144 can be joined or disposed adjacent to an edge of sole structure 130. In some embodiments, the remainder of first receptacle 144 (i.e., the substantially majority of first receptacle 144, extending between lower edge 160 and rear edge 156) remains unattached to article 100. Thus, although first receptacle 144 is disposed adjacent to upper 102, and may be in contact with upper 102 along one side, first receptacle 144 may be adjusted to form a space between first receptacle 144 and upper 102.

In FIG. 1, first receptacle 144 and forward edge 158 are diagonally oriented along the vertical direction, from sole structure 130 toward the portion of upper 102 associated with the ankle portion. However, in other embodiments, first receptacle 144 may be oriented along other directions. As will be discussed further below, first receptacle 144 and forward edge 158 of reinforcing member 104 may form an aperture between them that may be shaped or otherwise configured to receive a portion of first fastener 124.

In different embodiments, first fastener 124 may extend from anchor portion 168, extend over vamp portion 11, and be passed through first receptacle 144. In some embodiments, first fastener 124 may loop through and/or fold over first receptacle 144, forming a first looping section 198 (see FIG. 2). In one embodiment, in part due to the orientation of the aperture in first receptacle 144, first fastener 124 may be able to fold back (i.e., toward medial side 18). In some embodiments, first fastener 124 may extend toward medial side 18 and contact another securing element that is disposed along medial side 18.

For example, in FIGS. 2 and 3, second receptacle 146 is depicted, adjacent to instep portion 13 on medial side 18 of upper 102. Second receptacle 146 may be configured to receive a portion of a fastener. In the closed or secured state of fastening system 120 shown in FIGS. 2 and 3, a portion of first fastener 124 extends through second receptacle 146, such that a portion of first fastener 124 is also oriented in a direction along a lateral axis extending from lateral side 16 to medial side 18.

For purposes of reference, second receptacle 146 may include different regions. For example, second receptacle 146 may comprise an upper region 180 and a lower region 182. In some embodiments, first fastener 124 may extend through an aperture 152 disposed within upper region 180 of second receptacle 146. Upper region 180 may comprise various geometries. In one embodiment, upper region 180 of second receptacle 146 is a substantially oblong rectangular frame, and can be joined directly to lower region 182. In some embodiments, lower region 182 of second receptacle 146 can be further joined or linked to another element of fastening system 120. As will be described in further detail below with respect to FIGS. 8 and 9, in some embodiments, there may be one or more tensile elements 132 joined to lower region 182 (or other portions) of second receptacle 146.

Thus, in one embodiment, first fastener 124 may loop through and/or fold over upper region 180, forming a second looping section 199. In some embodiments, first fastener 124 may then extend back toward the direction of first receptacle 144 on lateral side 16. The operation of first fastener 124 with second receptacle 146 will be discussed further below with respect to FIGS. 4-7.

Fastening system 120 may also include additional components. As noted above, in some embodiments, fastening system 120 can include one or more tensile elements 132. Areas of one or both of lateral side 16 and medial side 18 can incorporate tensile elements 132. Referring to FIGS. 1-3, six tensile elements 132 extend in a generally diagonal direction (i.e., a rearwardly-angled direction) between lateral side 16 of forefoot portion 10, across vamp portion 11, and toward medial side 18 of midfoot portion 12. In some embodiments, one end of tensile elements 132 may be disposed adjacent to a forefoot edge 164 of upper 102, and extend rearward toward a midfoot edge 166 of upper 102 (see FIGS. 2 and 3). As will be discussed in further detail with respect to FIG. 9, tensile elements 132 may pass through one or more loops 170 before engaging with lower region 182 of second receptacle 146.

In one embodiment, portions of one or more tensile elements 132 may be generally aligned with a second diagonal axis 174. Second diagonal axis 174 may be nonparallel to first diagonal axis 172 in some embodiments. It can also be seen that second diagonal axis 174 is nonparallel to both lateral axis 20 and longitudinal axis 22 in the embodiment of FIGS. 1-3. However, in other embodiments, second diagonal axis 174 may be oriented along other directions.

In other words, tensile elements 132 may have various orientations that differ from those depicted. The angle of tensile elements 132 may be arranged in an orientation between zero and 90 degrees from the direction along longitudinal axis when viewing article 100 from the top-down (as in FIGS. 4-7). In one embodiment, tensile elements 132 are positioned relatively more adjacent to one another along medial side 18, and radiate outward as they approach lateral side 16 along forefoot portion 10. This configuration may, for example, distribute forces from midfoot portion 12 to an even wider area of forefoot portion 10 of upper 102. In other embodiments, tensile elements 132 may be arranged in any configuration, including a substantially parallel or intersecting arrangement.

It should be understood that other embodiments may include less than six tensile elements 132 or more than six tensile elements 132. Thus, in different embodiments, the various tensile elements 132 may be absent, or additional tensile elements 132 may be present to provide further structural components in article 100. Thus, upper 102 can include regions where tensile elements 132 are absent (e.g., along heel portion 14), which may enhance the stretch of article 100 in that area.

Referring also to FIGS. 1-3, tensile elements 132 are located between the inner liner (see inner liner 800 in FIG. 8) and outer liner 112. In other words, tensile elements 132 are disposed beneath outer liner 112. In other embodiments, tensile elements 132 may be disposed along any portion or layer of upper 102, including base layer 116. In one embodiment, tensile elements 132 may not be disposed beneath a liner or protective layer 118, and may be exposed (i.e., disposed on the outermost surface of upper 102). In some embodiments, the various combinations of tensile elements 132, base layer 116, the inner liner, and outer liner 112 may form substantially all of the thickness of upper 102 in some areas.

Furthermore, tensile elements 132 may engage with elements or materials disposed in other areas of upper 102. Thus, upper 102 may include provisions for routing tensile elements 132 outside or beyond outer liner 112, or for providing access to other areas of article 100. For example, in the embodiment of FIG. 2, an outer aperture 103 is included in outer liner 112. Outer aperture 103 may be configured to allow the passage of one or more tensile elements 132, or to allow tensile elements to contact second receptacle 146.

Tensile elements 132 may be formed from any generally one-dimensional material. As utilized with respect to the present invention, the term "one-dimensional material" or variants thereof is intended to encompass generally elongate materials exhibiting a length that is substantially greater than a width and a thickness. Accordingly, suitable materials for tensile elements 132 include various filaments, fibers, yarns, threads, cables, or ropes that are formed from rayon, nylon, polyester, polyacrylic, silk, cotton, carbon, glass, aramids (e.g., para-aramid fibers and meta-aramid fibers), ultra high molecular weight polyethylene, liquid crystal polymer, copper, aluminum, and steel. Whereas filaments have an indefinite length and may be utilized individually as tensile elements 132, fibers have a relatively short length and generally go through spinning or twisting processes to produce a strand of suitable length. An individual filament utilized in tensile elements 132 may be formed form a single material (i.e., a monocomponent filament) or from multiple materials (i.e., a bicomponent filament). Similarly, different filaments may be formed from different materials. As an example, yarns utilized as tensile elements 132 may include filaments that are each formed from a common material, may include filaments that are each formed from two or more different materials, or may include filaments that are each formed from two or more different materials. Similar concepts also apply to threads, cables, or ropes. The thickness of tensile elements 132 may also vary significantly to range from 0.03 millimeters to more than 5 millimeters, for example. Although one-dimensional materials will often have a cross-section where width and thickness are substantially equal (e.g., a round or square cross-section), some one-dimensional materials may have a width that is greater than a thickness (e.g., a rectangular, oval, or otherwise elongate cross-section). Despite the greater width, a material may be considered one-dimensional if a length of the material is substantially greater than a width and a thickness of the material.

It should be understood that the following figures are for purposes of illustration only, and each of the components described above with respect to FIGS. 1-3 may be included or referred to in the description while not illustrated in the figures.

As described above, article 100 may include provisions for securing the foot into article 100. Referring to FIGS. 4-7, a sequence of figures depicting the use of an embodiment of fastening system 120 is shown. Fastening system 120 and/or upper 102 may include a secured state (depicted in FIGS. 1-3), where first fastener 124 is closed and/or tightened. In the secured state, as described further below with respect to FIGS. 10 and 11, first fastener 124 and/or tensile elements 132 may exert a compressive force or tension along instep portion 13 and/or vamp portion 11. Furthermore, fastening system 120 and/or upper 102 may include an open state, where first fastener 124 has been loosened, and various components (e.g., portions of tongue 122, lace 134, first fastener 124) are free to move in different directions. In one embodiment, a user may adjust first fastener 124 to secure a foot in article 100 and transition article 100 from the open state to the secured state.

Figure 4:
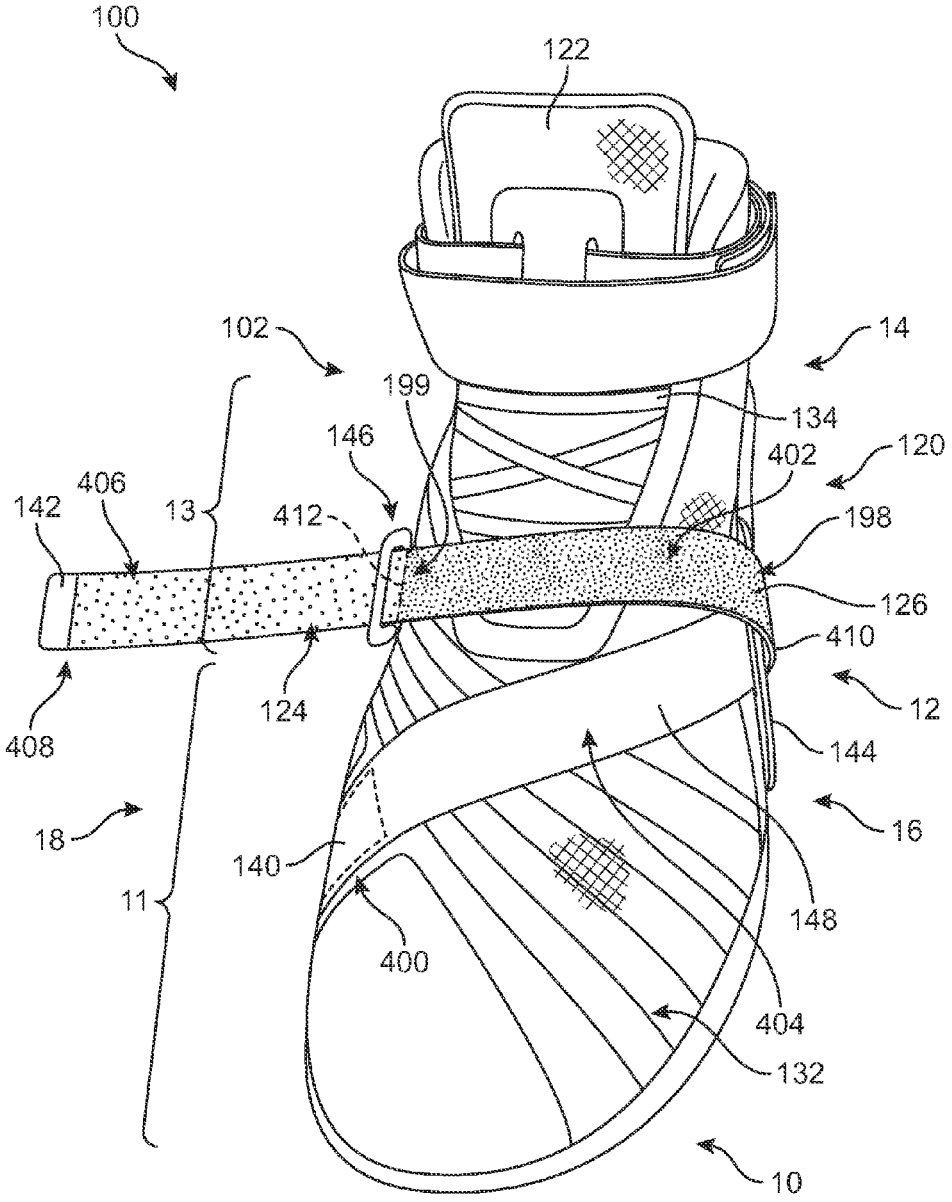
FIG. 4 is a schematic isometric view of an embodiment of an article of footwear including a fastening system.

In another embodiment, a user may adjust first fastener 124 to remove a foot from article 100 and transition article 100 from the secured state to the open state. One embodiment of this transition process is depicted in the sequence of FIGS. 4-7. In FIG. 4, a portion of first fastener 124 has been pulled away from upper 102 and raised, such that fastening system 120 is no longer in the secured state (the secured state being illustrated in FIGS. 1-3). A length of free portion 148 of first fastener 124 can be seen to extend in a substantially medial-lateral direction, from first receptacle 144 toward second receptacle 146, and out past medial side 18 of upper 102.

It should be understood that the different portions of first fastener 124 can vary in geometry, length, or width. For example, first fastener 124 may be wider or narrower along different portions. However, as shown in FIGS. 4-7, first fastener 124 can comprise a substantially uniform width. In other embodiments, the width may be irregular along the length of first fastener 124. In addition, first fastener 124 may comprise curved or irregular in some embodiments. In another embodiment, first fastener 124 may include substantially linear edges.

For purposes of reference, as shown in FIG. 4, free portion 148 of first fastener 124 may be divided into a secured end 400, an intermediate portion 404, a hook portion 402, a loop portion 406, and a free end 408. Secured end 400 may be disposed adjacent to fixed portion 140. Intermediate portion 404 may be demarcated from hook portion 402 by a first transition region 410. Furthermore, hook portion 402 may be demarcated from loop portion 406 by a second transition region 412. In FIG. 4 (as well as in FIGS. 1-3), it can be seen that while intermediate portion 404 extends generally over vamp portion 11, hook portion 402 and loop portion 406 may be generally disposed along instep portion 13. In other words, in some embodiments, there may be a first portion of first fastener 124 (including fixed portion 140 and intermediate portion 404) that extends along vamp portion 11, and a second portion of first fastener 124 (including hook portion 402 and loop portion 406) that may extend over instep portion 13.

Figure 5:
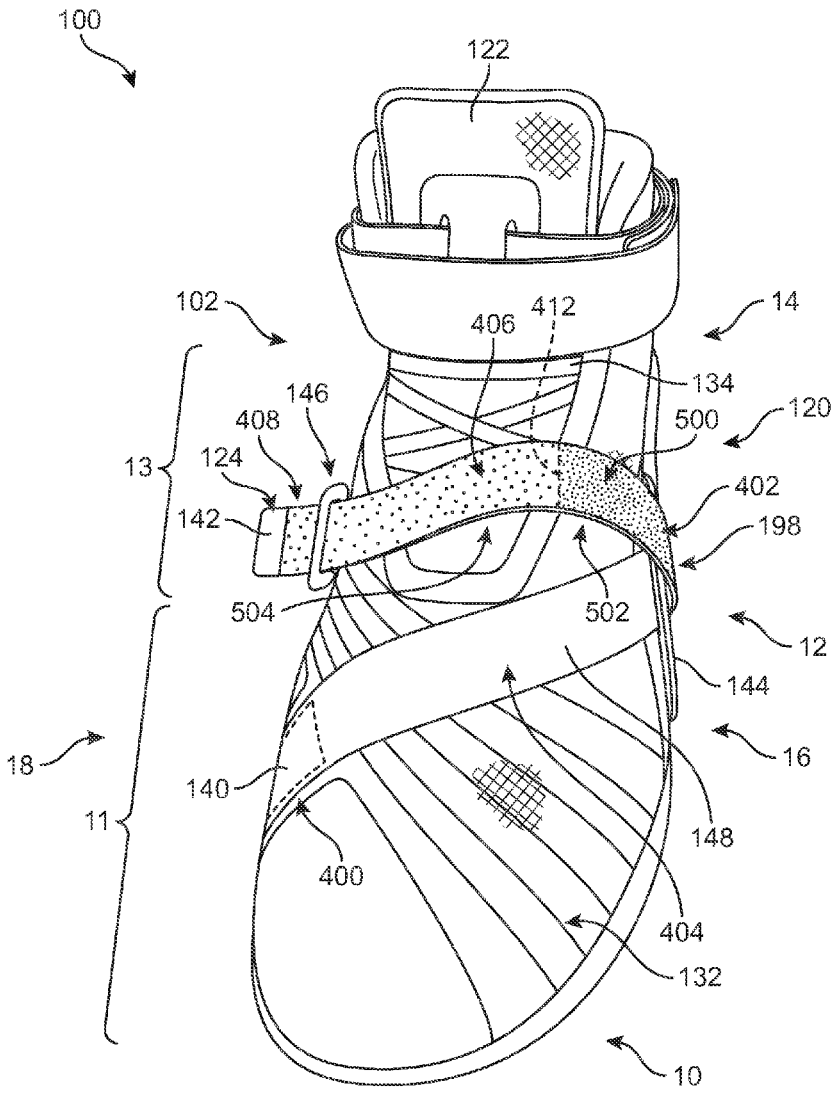
FIG. 5 is a schematic isometric view of an embodiment of an article of footwear including a fastening system.

Furthermore, referring to FIG. 5, first fastener 124 can include an inner side 500 and an opposing outer side 502. In some embodiments, hook portion 402 can include a first material of hook fastening materials along inner side 500, and loop portion 406 can include a second material of loop fastening materials along inner side 424. It should be understood that in other embodiments, the positions of loop portion 406 and hook portion 402 may be exchanged such that loop portion 406 is disposed below, and hook portion 402 is disposed above, when first fastener 124 is in its closed (secured) configuration, and hook portion 402 and loop portion 406 are joined to one another. Furthermore, in different embodiments, there may be portions of hook portion 402 and/or loop portion 406 that do not include fastening materials.

The first material and the second material of first fastener 124 as discussed above can be made of various materials, including Teflon loops, polyester hooks, Velcro, glass backing, and other touch fasteners. In one embodiment, the bond formed between the hook and loop materials can provide additional strength to fastening system 120 as the pulling forces can be spread evenly across all hooks. In some embodiments, the materials of hook portions and/or loop portions may be integrally formed with the material of first fastener 124. However, in other embodiments, the materials comprising hook portion and/or loop portion may be separately joined or attached to the material of first fastener 124. Outer side 502 of first fastener 124 may comprise a variety of different materials, as discussed above with reference to materials comprising upper 102.

Thus, first fastener 124 can be fed through and extend through the receptacles of fastening system 120, such that first looping section 198 contacts and engages with first receptacle 144, and second looping section 199 contacts and engages with second receptacle 146. The regions associated with first looping section 198 and second looping section 199 can vary, depending on the extent to which fastening system 120 is tightened or loosened. As a result of the hook and fastening materials mentioned above, when pull tab 142 of first fastener 124 is pulled from one side of article 100 toward the other side of article 100, each side (i.e., lateral side 16 and medial side 18) may be drawn toward the other. Once hook portion 402 comes into contact with loop portion 406, the first and second materials of the loop and hook fastener materials can engage, allowing a tightening and/or securement of first fastener 124, as shown previously in FIGS. 1-3.

Furthermore, as shown in FIGS. 4-7, article 100 can include provisions for loosening first fastener 124 and/or fastening system 120. In FIG. 5, the portion of first fastener 124 comprising hook portion 402 and loop portion 406 are depicted extending from first receptacle 144 on lateral side 16, over instep portion 13, and toward medial side 18 of upper 102, adjacent to second receptacle 146. In some embodiments, the increased loosening of first fastener 124 may form a curved arch 504 over instep portion 13. In some embodiments, intermediate portion 404 may remain disposed along vamp portion 11, similar to the embodiment of FIGS. 1-3. Thus, curved arch 504 may include hook portion 402 and loop portion 406 of first fastener 124 as it extends between lateral side 16 and medial side 18 (shown in FIG. 5). Depending on the extent that first fastener 124 is loosened, the length of curved arch 504 can vary. In one embodiment, this may represent the maximum loosening of fastening system 120 while first fastener 124 still passes through or contacts both receptacles.

Figure 6:
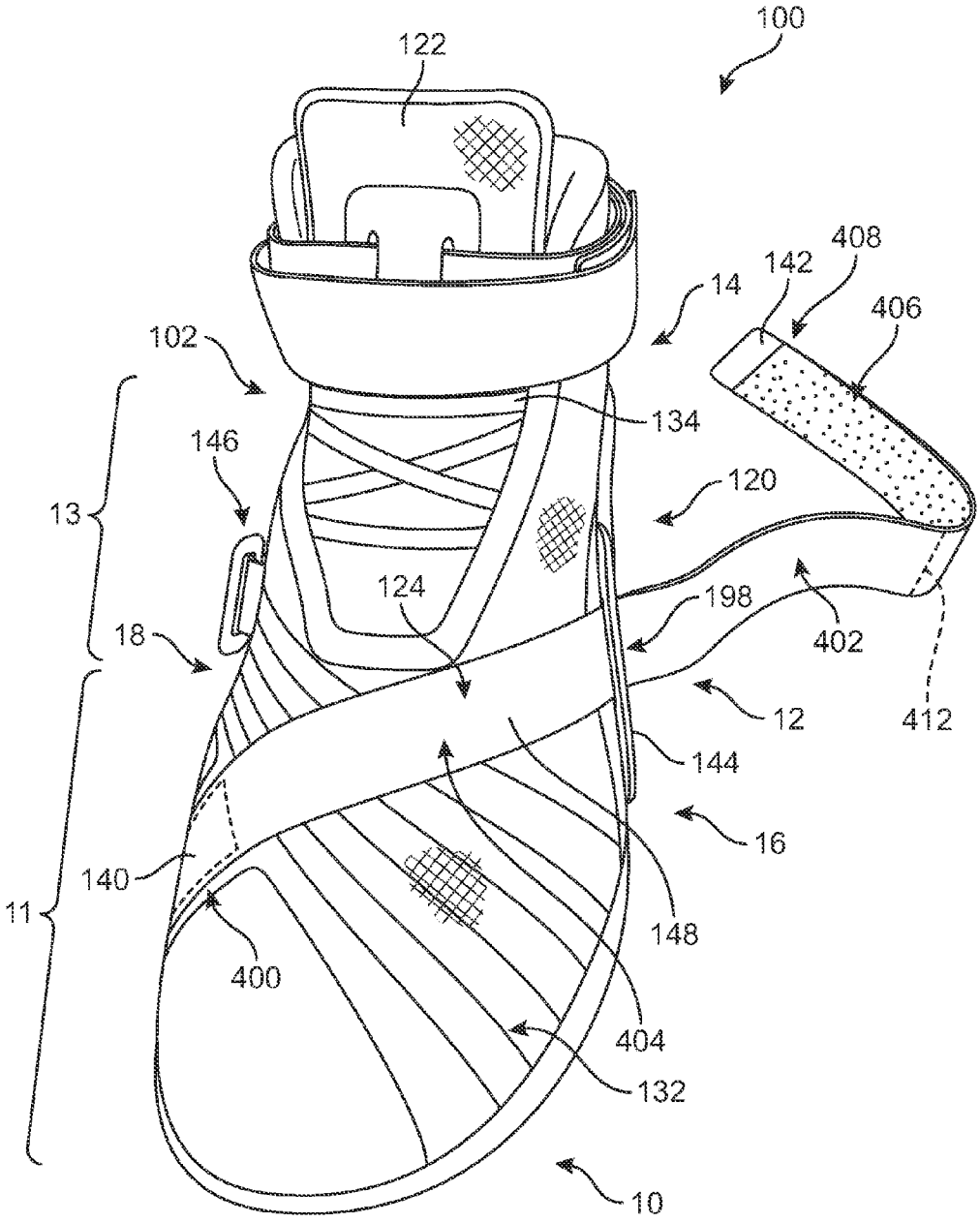
FIG. 6 is a schematic isometric view of an embodiment of an article of footwear including a fastening system.

In FIG. 6, first fastener 124 has been further loosened, such that free portion 148 has been removed from second receptacle 146. This can allow some dimensions of article 100 to be further adjusted or widened. Thus, a portion of first fastener 124 has been pulled away from article 100 toward lateral side 16, such that it extends beyond upper 102, while first transition region 410 remains engaged with first receptacle 144. In FIG. 6, hook portion 402 and loop portion 406 are depicted extending from first receptacle 144 on lateral side 16, while intermediate portion 404 extends over instep portion 13 in a diagonal orientation from lateral side 16 to medial side 18.

Figure 7:
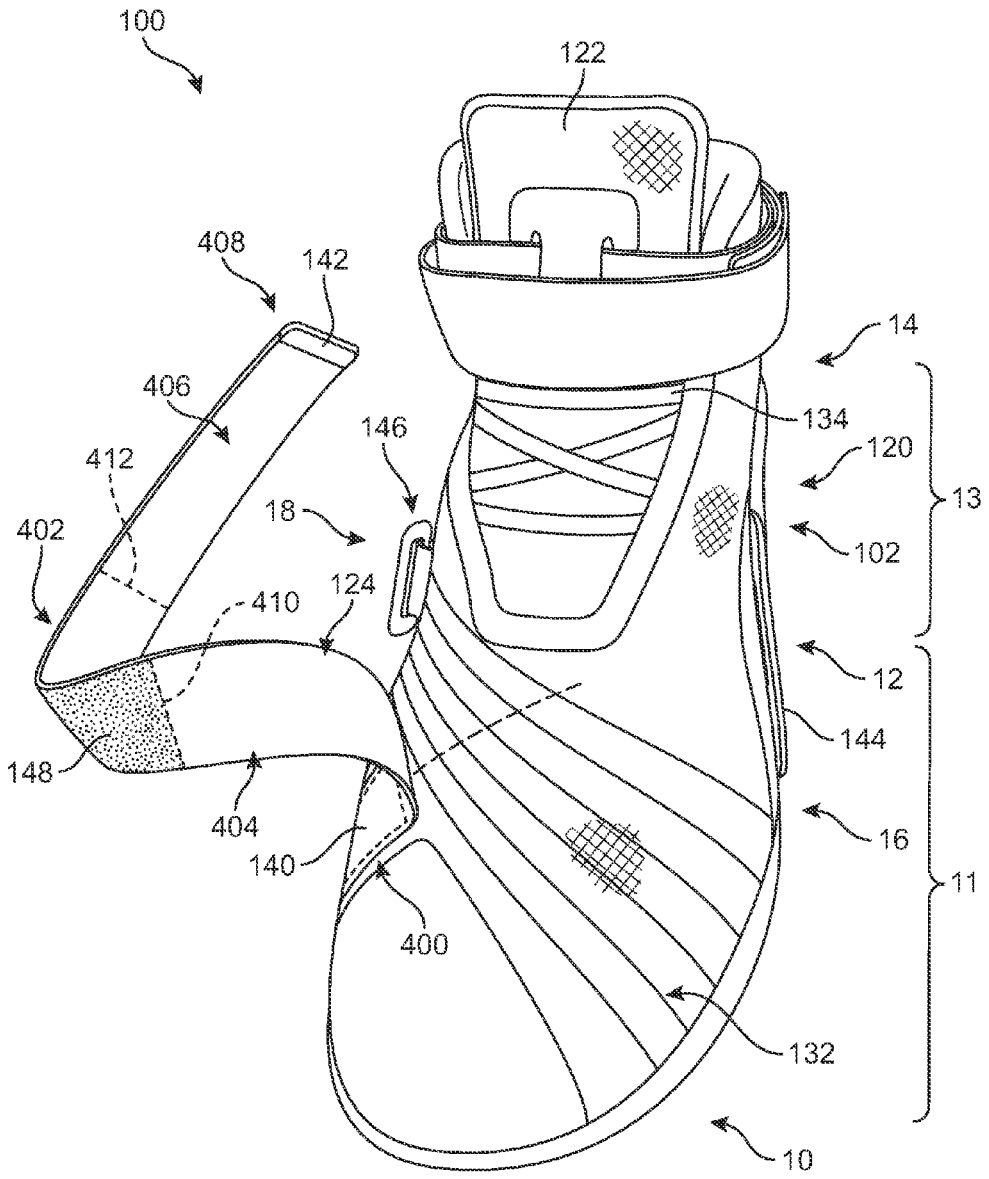
FIG. 7 is a schematic isometric view of an embodiment of an article of footwear including a fastening system.

In FIG. 7, first fastener 124 has been further loosened, such that free portion 148 has been removed from first receptacle 144. This can allow additional dimensions of article 100 to be further adjusted or widened. Thus, free portion 148 of first fastener 124 has been pulled away from article 100 toward medial side 18, such that it extends beyond upper 102, while secured end 400 remains joined to fixed portion 140. In other words, free portion 148 may be substantially free to be moved, adjusted, or arranged when separated from receptacles. In one embodiment, this may represent the maximum loosening of fastening system 120.

As described above, in some embodiments, article 100 includes an upper 102 that can comprise several layers. Furthermore, fastening system 120 of article 100 may include various tensile or fastening elements that may contact different layers of upper 102 and/or sole structure 130. Each layer of upper 102 and portions of the fastening system can be designed to extend around or interact with various regions along article 100. This arrangement can be observed in FIG. 8, which is an exploded isometric view of one embodiment of article 100. Sole structure 130 is disposed nearest to the bottom, while the layers comprising upper 102 are disposed above.

As noted previously, base layer 116 can be configured to form interior cavity 106 for insertion of a wearer's foot. Disposed adjacent to base layer 116 is an inner liner 800, described above with respect to FIGS. 1-3. In one embodiment, inner liner 800 is disposed closer to base layer 116 than outer liner 112. However, in other embodiments, inner liner 800 may be disposed above outer liner 112, or article 100 may not include inner liner 800.

Protective layer 118 is depicted as being directly adjacent to external portions of outer liner 112, such that portions of outer liner 112 are covered by protective layer 118. In some embodiments, protective layer 118 and portions of outer liner 112 may be joined to form a unified structural layer, though in other embodiments, protective layer 118 and outer liner 118 may comprise two distinct surfaces.

Figure 8:
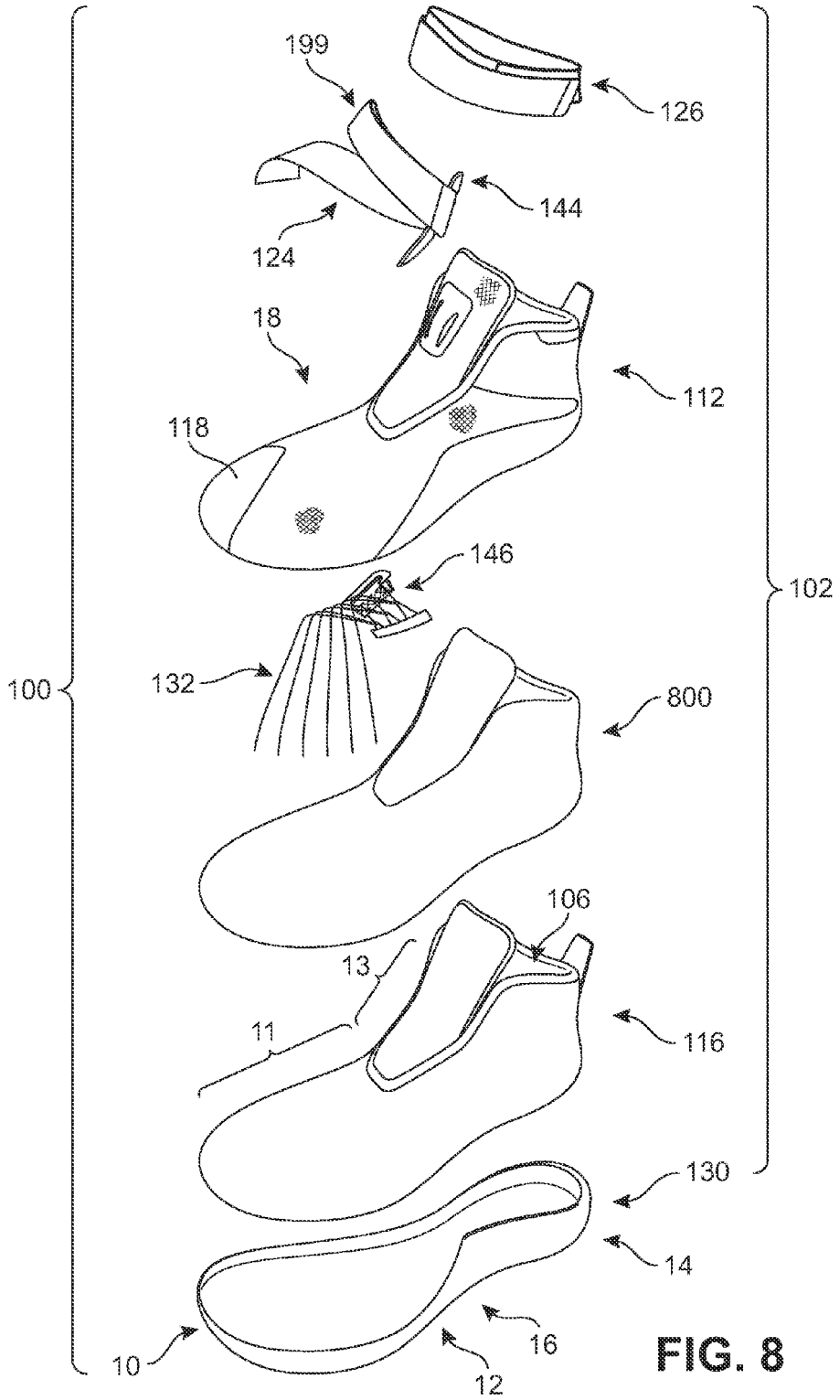
FIG. 8 is a exploded view of an embodiment of an article of footwear.

Furthermore, as shown in FIG. 8, portions of the fastening system can be disposed between inner liner 800 and outer liner 112. In one embodiment, a majority of tensile elements 132 can be disposed along or on top of inner liner 800. In another embodiment, tensile elements 132 may be covered to some extent by outer liner 112. In some embodiments, covered portions of tensile elements 132 may not be visible when article 100 is assembled (e.g., portions of tensile elements 132 and/or inner liner 800 may not be visible in the assembled article).

Above outer liner 112, first fastener 124 and second fastener 126 are also depicted. As shown in FIG. 8, second fastener 126 is associated with optional ankle cinching system 138 (see FIGS. 1-3), such that first fastener 124 is disposed nearer to forefoot portion 10 than second fastener 126. First fastener 124 may be passed through upper portion of second receptacle 146 along second looping section 199.

Some embodiments of article 100 include provisions that permit the various components or elements of fastening system 120 to operate in conjunction with one another. As mentioned above, in different embodiments, tensile elements 132 and first fastener 124 may intersect or be bridged via second receptacle 146. In other embodiments, the intersection region may comprise another element, different from second receptacle 146, or tensile elements 132 and first fastener 124 may be directly joined without a separate intersecting element. In one embodiment, first fastener 124 and tensile elements 132 may be integrated into a single system. Thus, in some embodiment, the fastening system may be configured to provide multiple directions of stretch-resistance with minimum adjustment. In other words, a force exerted along first fastener 124 can also exert a force along tensile elements 132 in some embodiments. The parallel operation of both elements (i.e., first fastener 124 and tensile elements 132) of fastening system 120 will be discussed in further detail below with respect to FIGS. 10 and 11.

During walking, running, or other ambulatory activities, a foot within the interior cavity of an article may tend to stretch upper 102. That is, many of the material elements forming upper 102 may stretch when placed in tension by movements of the foot. Although tensile elements 132 may also stretch, tensile elements 132 generally stretch to a lesser degree than the other material elements forming upper 102 (e.g., base layer 116, inner liner 800, and/or outer liner 112, shown in FIG. 8). In some embodiments, one or more tensile elements 132 may be located to provide structural components in upper 102 that (a) resist stretching in specific directions or locations, (b) limit excess movement of the foot relative to sole structure 130 and upper 102, (c) ensure that the foot remains properly positioned relative to sole structure 130 and upper 102, and/or (d) reinforce locations where forces are concentrated.

Figure 9:
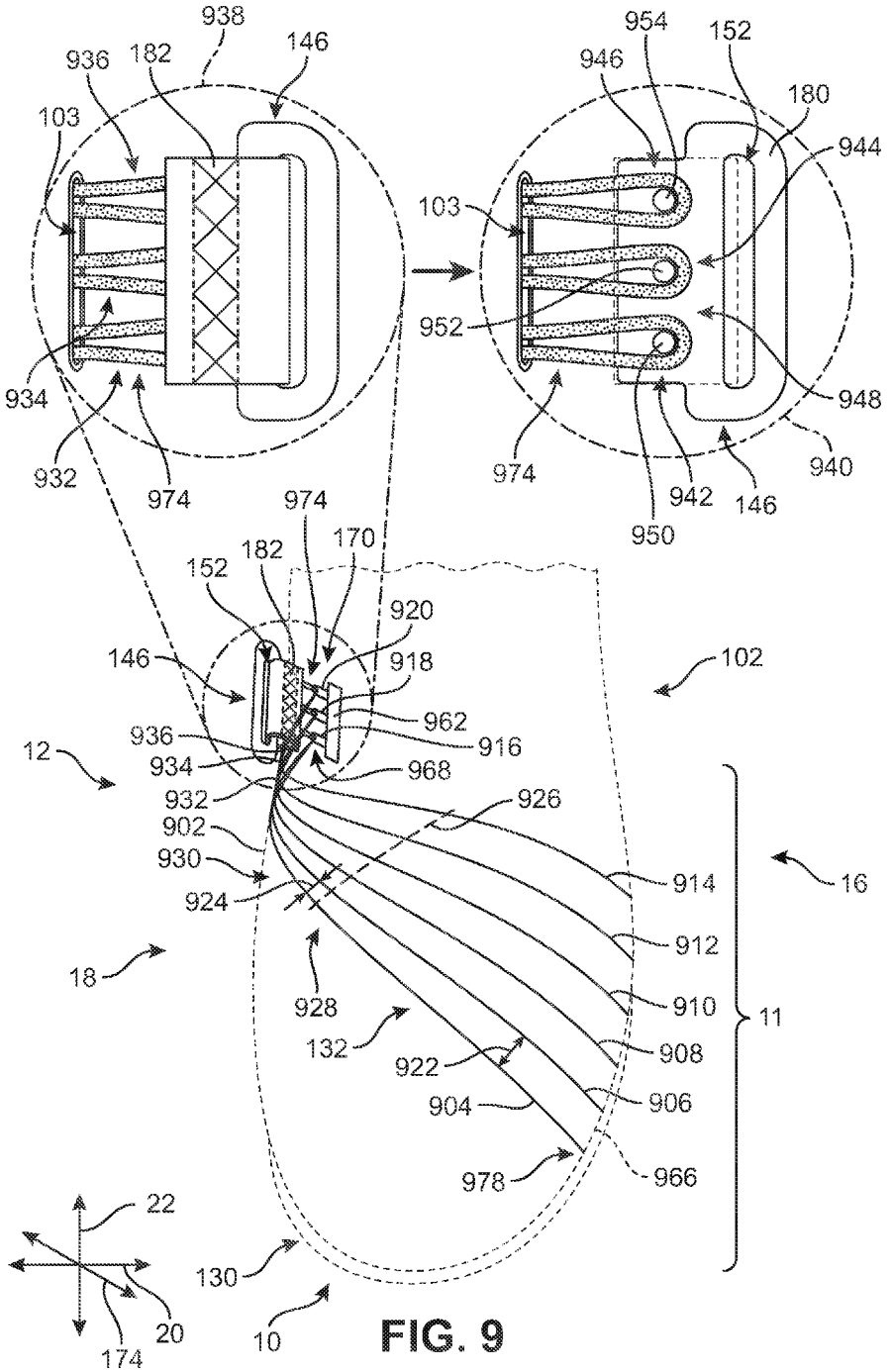
FIG. 9 is a schematic isometric view of an embodiment of an article of footwear including tensile elements.

In order to better appreciate the utility of tensile elements 132 in fastening system 120, an exposed portion of upper 102 is depicted in FIG. 9. Outer liner 112 has been removed for clarity, and sole structure 130 and upper 102 are shown in dotted line. Tensile elements 132 can be seen as arranged in a substantially diagonal orientation across vamp portion 11 in FIG. 9. As noted above, in one embodiment, portions of tensile elements 132 may be arranged such that they are generally aligned or parallel with second diagonal axis 174. However, it should be understood that this alignment is for purposes of reference only, and that one or more portions of various tensile elements 132 may curve or follow other orientations.

As shown in FIG. 9, tensile elements 132 may extend from lateral side 16 of forefoot portion 10, adjacent a forefoot edge 966 of upper 102. In some embodiments, a portion of tensile elements 132 may be disposed between upper 102 and sole structure 130. Tensile elements 132 may extend across vamp portion 11 and pass through one or more loops 170 disposed along midfoot portion 12, adjacent to a midfoot edge 902. Loops 170 may extend from and/or be integrally joined to a strap portion 962 in some embodiments. In some embodiments, strap portion 962 can provide an anchoring or securing device for loops 170, or a means of holding or gathering loops 170 together. However, in other embodiments, loops 170 may be directly joined to upper 102 or sole structure 130 without strap portion 962. In FIG. 9, three loops are shown, including a first loop 916, a second loop 918, and a third loop 920. A portion of first loop 916, second loop 918, and/or third loop 920 may be stitched to or otherwise extend from strap portion 962 in some embodiments. In another embodiment, one or more loops 170 may be stitched or joined directly to a portion of article 100.

In some embodiments, loops 170 and strap portion 962 may be formed of materials similar to those described for tensile elements 132, though in other embodiments, other textiles, knitted or woven elements, or materials may be used. In one embodiment, the materials for different portions can be configured depending on the amount of friction or resistance desired between tensile elements 132 and loops 170.

Thus, in some embodiments, vamp portion 11 of upper 102 may be configured to resist stretch in the medial-lateral direction as a result of tensile elements 132. In other embodiments, vamp portion 11 of upper 102 may be configured to resist stretch along longitudinal axis 22. In one embodiment, due to the diagonal orientation of tensile elements 132, vamp portion 11 of upper 102 may be configured to resist stretch along both lateral axis 20 as well as the direction along longitudinal axis. Thus, when performing a cutting motion (i.e., side-to-side movement of the wearer), tensile elements 132 can assist with resisting side-ways movement of the foot to ensure that the foot remains properly positioned relative to article 100. That is, tensile elements 132 may resist stretch in upper 102 that may otherwise allow the foot to roll off of sole structure 130. Accordingly, in one embodiment, tensile elements 132 resist stretch in upper 102 due to cutting motions and ensure that the foot remains properly positioned relative to article 100. Furthermore, when performing a braking motion (i.e., slowing the forward momentum of the wearer), tensile elements 132 can assist with resisting stretch in upper 102 that may allow the foot to slide forward or separate from sole structure 130. Tensile elements 132 can also resist stretch in upper 102 due to flexing of article 100 in the area between forefoot portion 10 and midfoot portion 12.

In the embodiment of FIG. 9, tensile elements 132 include a first element 904, a second element 906, a third element 908, a fourth element 910, a fifth element 912, and a sixth element 914. Although each of tensile elements 132 may be formed from similar materials, in some embodiments, different strands may have varying properties. For example, second element 906 may be formed to have a greater tensile strength than first element 904. In another example, first element 904 and second element 906 may be formed from the same material, but the thickness of second element 906 may be greater than the thickness of first element 904, imparting greater tensile strength. In some embodiments, tensile elements 132 may be configured to differ to accommodate the varying forces induced in upper 102 during braking motions relative to cutting motions. In order to account for the differences in the forces from braking and cutting, some tensile elements 132 may exhibit different tensile strengths.

For purposes of convenience, the portion of tensile elements 132 that contact and/or pass through loops 170 may be referred to as pivoting portions 968. The region of tensile elements 132 associated with pivoting portions 968 may change depending on the amount of tension applied along the fastening system (i.e., tensile elements 132 may slide back and forth through loops 170 as tension is applied or removed). Once tensile elements 132 have engaged with loops 170, they may extend upward to join with lower region 182 of second receptacle 146.

For purposes of reference, the portion of tensile elements 132 that contact forefoot edge 966 of upper 102 may be referred to as proximal ends 978, and the portion of tensile elements 132 that exits from loops 170 to join with second receptacle 146 may be referred to as distal ends 974 of tensile elements 132. It should be understood that the lengths of distal ends 974 can vary depending on the tension applied to fastening system 120.

In different embodiments, proximal ends 978 of tensile elements 132 may be attached to article 100 in a variety of ways. In some embodiments, tensile elements 132 may be attached along an underside of upper 102, for example, between upper 102 and a component of sole structure 130, before upper 102 is joined with sole structure 130 during the manufacture of article 100. In one embodiment, tensile elements 132 may be secured by the application of one or more enforcement strips or bonds that join tensile elements 132 to the underside of upper 102 or sole structure 130. Such enforcement strips may comprise techniques known in the art, including but not limited to adhesives (such as a polymer adhesive), or machine or hand-stitching. Loops 170 or strap portion 962 may be joined to upper 102 and/or sole structure 130 using similar techniques or they may be attached in a manner that differs from the attachment of proximal ends 978. In some embodiments, anchor portions (similar to anchor portion 168 discussed above with respect to FIGS. 1-3) may be used to secure tensile elements 132.

In some embodiments, fastening system 120 may include provisions for securing one or more tensile elements 132, and/or for routing tensile elements 132 in a specific orientation. For example, in some embodiments, tensile elements 132 may contact or engage with an anchor element 926. In FIG. 9, anchor element 926 extends along upper 102 from medial side 18, and terminates adjacent to sixth element 914 on lateral side 16. In one embodiment, anchor element 926 may extend further toward medial side 18 or lateral side 16. In some embodiments, anchor element 926 can be disposed beneath fixed portion 140 of first fastener 124 (shown in FIGS. 1-3) in the assembled article. Furthermore, anchor element 926 may cross or intersect with one or more of tensile elements 132 in some embodiments.

In different embodiments, similar to loops 170, anchor element 926 may comprise materials similar to that of tensile elements 132 or materials that are substantially different. In one embodiment, the materials for different portions of anchor element 926 can be configured depending on the amount of resistance or anchoring strength desired between tensile elements 132 and anchor element 926.

As noted above with respect to first fastener 124, it should be understood that other portions of fastening system 120 may comprise fixed or permanent attachment regions, while other portions may comprise free or adjustable regions. For example, tensile elements 132 may include regions where tensile elements 132 are fixedly attached to upper 102 in some embodiments. In addition, in some embodiments, tensile elements 132 may include regions where tensile elements 132 are free or unattached to another element of article 100. In FIG. 9, each of tensile elements 132 are bonded or joined to upper 102 along a first region 928. First region 928 occurs from proximal ends 978 of tensile elements 132 to the intersection of tensile elements 132 with anchor element 926. Beyond the intersection with anchor element 926, toward medial side 18, tensile elements 132 are substantially free and may be configured to move along a second region 930. In some embodiments, first region 928 may be disposed nearer to forefoot portion 10 than second region 930. The attachment between tensile elements 132 and upper 102 may be formed through sewing, stitching, fusion, bonding, glue (by an adhesive or other agents), or a combination of thereof, as well as anchor portions. In some embodiments, the fixed attachment regions (e.g., first region 928) can provide a higher level of strength and stability, and can also be used to provide design or ornamental enhancements to an article.

It should be understood that in other embodiments, fewer or no tensile elements 132 may be attached to upper 102. In some embodiments, the substantial entirety of a tensile element may be free to move. In another embodiment, the substantial entirety or majority of a tensile element may be joined or fixedly attached to a portion of the article. Furthermore, areas of fixed attachment may occur independent of the presence of an anchor element 926

Thus, in one embodiment, first region 928 is demarcated from second region 930 by anchor element 926 In some embodiments, upon engaging with anchor element 926 tensile elements 132 may be drawn or disposed closer toward a neighboring tensile element. For example, in FIG. 9, first element 904 and second element 906 contact anchor element 926 and are disposed relatively closer together than along their proximal ends 978. In other words, as tensile elements 132 extend across vamp portion 11 from lateral side 16 of upper 102 toward medial side 18, one or more of the tensile elements may merge closer toward one another. In the embodiment of FIG. 9, the distance between some of the tensile elements decreases in the direction extending from proximal ends 978 to distal ends 974. For example, a first distance 922 between first element 904 and second element 906 is larger than a second distance 924 between first element 904 and second element 906. However, in other embodiments, the distance between one or more tensile elements 132 may remain substantially constant or increase.

Thus, in some embodiments, two or more tensile elements 132 may group or cluster together as they approach medial side 18. In one embodiment, there may be an even number of tensile elements 132, and a pairing can occur between the tensile elements that are disposed directly adjacent to one another. In the embodiment of FIG. 9, after passing anchor element 926, first element 904 closely approaches second element 906, third element 908 closely approaches fourth element 910, and fifth element 912 closely approaches sixth element 914. As tensile elements 132 approach loops 170, it can be seen that a first pair 932, a second pair 934, and a third pair 936 of tensile elements 132 have been formed. Each of these pairs may be better viewed in a first magnified area 938, discussed further below. In one embodiment, each pair of tensile elements 132 may include a portion that is disposed against one another (i.e., such that the two strands contact one another).

Fastening system 120 may include provisions for tensile elements 132 to be guided or routed along different areas of upper 102. For example, in FIG. 9, it can be seen that first pair 932 passes through first loop 916, second pair 934 passes through second loop 918, and third pair 936 passes through third loop 920 (via pivoting portion 968). After protruding through loops 170, each pair can be joined to second receptacle 146, as shown in first magnified area 938 and a second magnified area 940.

In first magnified area 938, first pair 932, second pair 934, and third pair 936 are shown as they engage with lower region 182 of second receptacle 146. Lower region 182 may comprise various materials, including textiles and/or plastic or relatively rigid materials. Furthermore, lower region 182 may be further reinforced and bonded along second receptacle 146 by stitching or other attachment methods.

As shown in second magnified area 940, in some embodiments, each of the pairs of tensile elements 132 can form a looping or clasping configuration along an interior 948 of lower region 182. Thus, portions of proximal ends 978 of tensile elements 132 may join or be inserted within an interior 948 of second receptacle 146. In second magnified area 940, a first loop region 942, a second loop region 944, and a third loop region 946 of tensile elements 132 are shown. First loop region 942 may comprise the merging of first element 904 and second element 906, second loop region 944 may comprise the merging of third element 908 and fourth element 910, and third loop region 946 may comprise the merging of fifth element 912 and sixth element 914. In other words, although six tensile elements 132 are present along vamp portion 11, upon engagement with second receptacle 146, each pair of tensile elements 132 may be revealed to be formed from a single or continuous strand. In other embodiments, more than two, or all, of tensile elements 132 may comprise a single strand. However, in another embodiment, each tensile element 132 may comprise an individual strand, and be attached separately to second receptacle 146.

In some embodiments, first loop region 942, second loop region 944, and third loop region 946 of tensile elements 132 may contact, engage, or otherwise extend around a hook or anchoring protrusion within second receptacle 146. For example, FIG. 9 depicts a configuration where three hook portions—including a first hook 950, a second hook 952, and a third hook 954—provide an element for receiving and/or securing tensile elements 132 within interior 948. In FIG. 9, each loop region is depicted as extending around a corresponding hook portion. Thus, in some embodiments, first loop region 942 extends around and is secured by first hook 950, second loop region 944 extends around and is secured by second hook 952, and third loop region 946 extends around and is secured by third hook 954.

As another example, one or more apertures may be utilized to receive tensile elements 132, such that the tensile elements extend through one or more apertures disposed within second receptacle 146. Hook portions and apertures provide only a few examples of a strand-receiving element with which tensile elements 132 may engage. In other configurations of article 100, grooves, tunnels, or metal or textile loops may be utilized in place of hook portions, or grommets may define the apertures. Accordingly, distal ends 974 may engage with a variety of strand-receiving elements in second receptacle 146.

Also shown in second magnified area 940 is an enlarged view of upper region 180 of second receptacle 146. As noted above with respect to FIGS. 1-3, it can be seen that upper region 180 includes aperture 152. Upper region 180 may thus provide a guide or routing element for a portion of fastening system 120 in some embodiments, as well as a gripping member for a user to hold while adjusting a fastener, as discussed previously.

In different embodiments, the engagement or association of different components of fastening system 120 with one another can allow a user to alter the tension throughout multiple regions of article 100 with a single and relatively swift adjustment. Thus, in one embodiment, the interrelationship of first fastener 124 with tensile elements 132 can provide a user with an enhanced ability to increase stretch-resistance over a large proportion of upper 102 through a minimum number of adjustment steps. For example, as described above, distal ends 974 tensile elements 132 are anchored or secured along one end of second receptacle 146, and second looping section 199 of first fastener 124 can engage or be secured along another end of second receptacle 146, creating an intersection point between the different elements.

Figure 10:
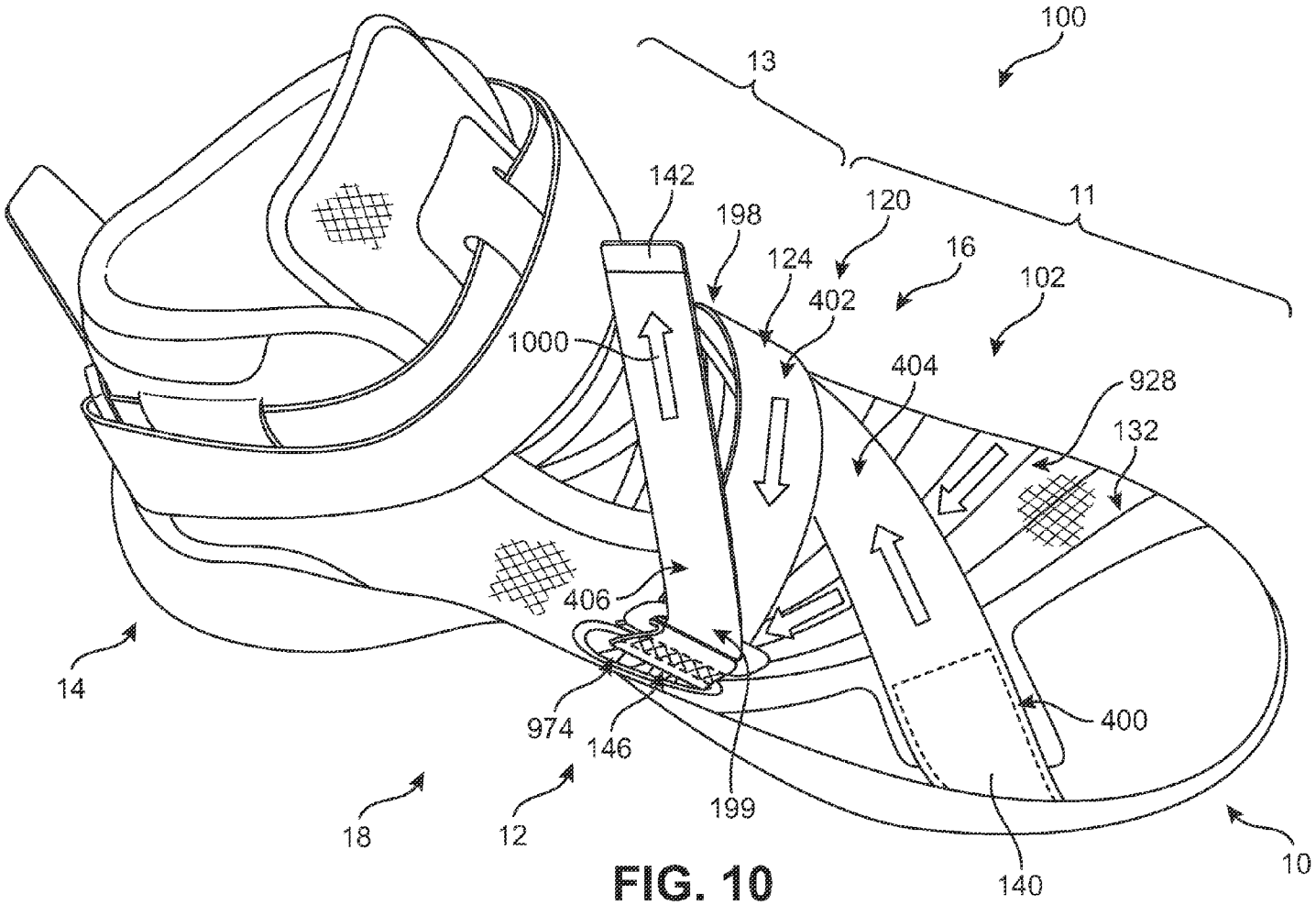
FIG. 10 is a schematic isometric view of an embodiment of an article of footwear including a fastening system.
Figure 11:
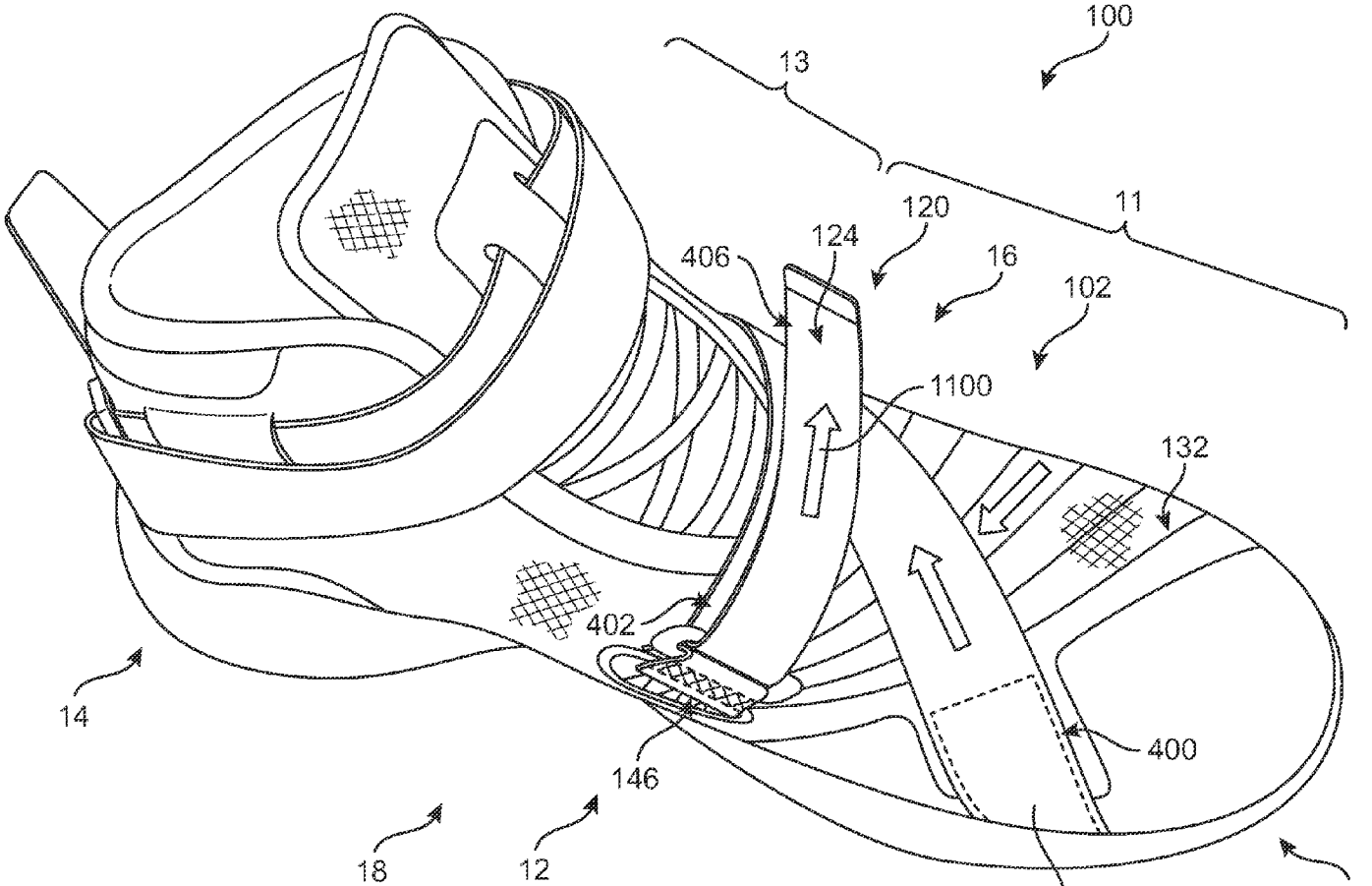
FIG. 11 is a schematic isometric view of an embodiment of an article of footwear including a fastening system.

Referring to FIGS. 10 and 11, first fastener 124 can engage with both the first receptacle (not shown) and second receptacle 146, as described above with respect to FIGS. 1-3. In FIG. 10, upper 102 is in the open state, such that a foot would not yet be secure within article 100. As a pulling force 1000 (represented by arrows in FIG. 10) is exerted via pull tab 142 along loop portion 406 of first fastener 124, at least some if not the substantial majority of pulling force 1000 can be transmitted or distributed through second looping section 199 disposed through second receptacle 146 to hook portion 402 of first fastener 124. Pulling force 1000 may further be transmitted or distributed to the diagonally laid intermediate portion 404 via first looping section 198 extending through the first receptacle (not shown). Because intermediate portion 404 is joined to secured end 400 along fixed portion 140, this process may draw medial side 18 of forefoot portion 10 of upper 102 back toward midfoot portion 12, and increase stretch-resistance and overall tautness of the region.

Furthermore, some or substantially all of pulling force 1000 may also be transmitted or distributed along to tensile elements 132. As second looping section 199 passes through second receptacle 146 and exerts an upward force, distal ends 974 of tensile elements 132 anchored within the lower portion of second receptacle 146 may be tugged or pulled upward. Pulling force 1000 may further be transmitted or distributed to the diagonally disposed tensile elements 132 via the pivoting portions (shown in FIG. 9) extending through the loops (shown in FIG. 9). Because tensile elements 132 are joined to vamp portion 11 of upper 102 along first region 928, this process may draw lateral side 16 of forefoot portion 10 of upper 102 back toward midfoot portion 12, and increase stretch-resistance and overall tautness of the region.

In FIG. 11, loop portion 406 has been engaged with hook portion 402. Thus, upper 102 is in the closed state, such that a foot would be secure within article 100. In one embodiment, vamp portion 11 of upper 102 can be securely wrapped around at least a portion of a user's foot by fastening system 120 as disclosed herein. In some embodiments, a hoop stress or circumferential stress may be applied over the area of a user's foot forward of the ankle through utilization of fastening system 120. In FIG. 11, a sustained compressive tension 1100 (represented by arrows) is transmitted or distributed throughout the various elements of fastening system 120. Thus, from loop portion 406 and across vamp portion 11, the tension that is stored through the engagement between hook portion 402 and loop portion 406 can be transmitted or distributed. In other words, in one embodiment, a user may be able to readily increase the snug fit of an article with a relatively simple pulling step along a single fastener. Fastening system 120 may also allow a user to apply a compressive force around vamp portion 11 or instep portion 13 of article 100 in some embodiments.

Furthermore, it should be understood that depending upon the specific configuration of article 100 and the intended use of article, base layer 116, inner liner 800, outer liner 112, and/or protective layer 118 (discussed above with reference to FIG. 8) may be non-stretch materials, materials with one directional stretch, or materials with two-directional stretch, for example. In general, forming the layers of upper 102 from materials with two-directional stretch provides upper 102 with a greater ability to conform with the contours of the foot, thereby enhancing the comfort of article 100. In configurations where one or more of the layers have two-directional stretch, the combination of tensile elements 132 with the layers can effectively vary the stretch characteristics of upper 102 in specific locations. For example, the combination of tensile elements 132 with upper 102 that has a two-directional stretch forms zones in upper 102 that have different stretch characteristics, and the zones include (a) first zones where no tensile elements 132 or fasteners 108 are present, and upper 102 exhibits two-directional stretch, (b) second zones where tensile elements 132 are present, and upper 102 exhibits one-directional stretch in a direction that is orthogonal (i.e., perpendicular) to tensile elements 132, and (c) third zones where tensile elements 132 are present and interact with first fastener 124, such that upper 102 may exhibit substantially no stretch or limited stretch when tension is applied to fastening system 120. Accordingly, in some embodiments, the overall stretch characteristics of particular areas of upper 102 may be controlled by presence of tensile elements 132 and/or fasteners 108, and whether tensile elements 132 and fasteners 108 cross each other.

In different embodiments, changing the locations where first fastener 124, tensile elements 132, first receptacle 144, and/or second receptacle 146 are secured can change the direction of tension or force provided by fastening system 120. In some embodiments, fastening system 120 can be configured apply a circumferential force or hoop stress about heel portion 14 of article 100, for example. In other embodiments, fastening system 120 may be oriented to apply tension in other parts of article 100.

This description of features, systems, and components is not intended to be exhaustive and in other embodiments, article may include other features, systems and/or components. Moreover, in other embodiments, some of these features, systems and/or components could be optional. As an example, some embodiments may not include lace 134 or outer liner 112.

While various embodiments have been described, the description is intended to be exemplary, rather than limiting and it will be apparent to those of ordinary skill in the art that many more embodiments and implementations are possible that are within the scope of the embodiments. Although many possible combinations of features are shown in the accompanying figures and discussed in this detailed description, many other combinations of the disclosed features are possible. Any feature of any embodiment may be used in combination with or substituted for any other feature or element in any other embodiment unless specifically restricted. Therefore, it will be understood that any of the features shown and/or discussed in the present disclosure may be implemented together in any suitable combination. Accordingly, the embodiments are not to be restricted except in light of the attached claims and their equivalents. Also, various modifications and changes may be made within the scope of the attached claims.

What is claimed is:

1. An article of footwear, the article of footwear comprising:

an upper, the upper including an outermost surface;

a forefoot portion, a midfoot portion, a medial side, and a lateral side;

the upper including an inner liner and an outer liner;

a fastening system, the fastening system comprising a fastener, a plurality of tensile elements, a first receptacle on the lateral side, and a second receptacle on the medial side;

at least a portion of the plurality of tensile elements being disposed between the inner liner and the outer liner;

the plurality of tensile elements including a first tensile element, wherein the plurality of tensile elements extend from a forefoot edge at the lateral side of the upper in the forefoot portion to the second receptacle positioned at the medial side of the upper in the midfoot portion, the plurality of tensile elements being spaced apart from one another along at least a portion of the upper, the plurality of tensile elements being spaced further apart at the forefoot edge than at the second receptacle;

wherein the first tensile element engages with a lower region of the second receptacle;

wherein the second receptacle is disposed adjacent to the midfoot edge, and wherein the plurality of tensile elements are joined to the second receptacle;

wherein the fastener is disposed proximate the outermost surface, the fastener extending from a forefoot portion on the medial side to the first receptacle on the lateral side, and from the first receptacle on the lateral side to the second receptacle on the medial side; and the fastener engaging with the upper region of the second receptacle.

2. The article of footwear according to claim 1, wherein the outer liner includes an aperture, and wherein the plurality of tensile elements extend through the aperture to engage with the receptacle.

3. The article of footwear according to claim 1, wherein the upper further includes a base layer that forms an interior cavity configured to receive a foot, and wherein the base layer is disposed beneath the inner liner.

4. The article of footwear according to claim 1, wherein at least a portion of the outer liner comprises an outermost layer of the upper.

5. The article of footwear according to claim 1, wherein the plurality of tensile elements are fixedly attached to the receptacle.

6. The article of footwear according to claim 4, wherein the outermost layer comprises a mesh material joined to a protective layer.

7. An article of footwear, the article of footwear comprising:

a base axis, a first diagonal axis, and a second diagonal axis, wherein the base axis, the first diagonal axis, and the second diagonal axis are nonparallel, and wherein the base axis extends from one side of the article of footwear to an opposing side of the article of footwear;

an upper and a fastening system;

the fastening system including a fastener, a first receptacle, and a plurality of tensile elements, the plurality of tensile elements including a first tensile element and a second tensile element;

wherein the first tensile element and the second tensile element comprise two portions of a continuous tensile strand;

the upper comprising a first portion and a second portion;

the first receptacle comprising an upper region and a lower region;

the plurality of tensile elements being disposed along the first portion of the upper and being substantially aligned with the second diagonal axis;

the fastener engaging with the upper region of the first receptacle and the plurality of tensile elements engaging with the lower region of the first receptacle;

an interior region of the lower region of the first receptacle including a hook portion that extends from a surface of the first receptacle, a portion of the continuous tensile strand being looped around the hook portion;

the fastening system including a secured state and an unsecured state;

the fastener comprising a single strap that extends from the medial side to the lateral side and back to the medial side, a first portion of the fastener being secured to the medial side of the upper in a forefoot region and disposed along the first portion of the upper in the secured state, wherein the first portion of the fastener is substantially aligned with the first diagonal axis;

a second portion of the fastener being disposed along the second portion of the upper in the secured state and extending from the lateral side to the medial side, wherein the second portion of the fastener is substantially aligned with the base axis;

wherein the fastening system is configured to distribute a compressive tension over at least a portion of the second portion of the upper and at least a portion of the first portion of the upper when the fastening system is in the secured state.

8. The article of footwear according to claim 7, wherein the continuous tensile strand is fixedly attached to the first receptacle.

9. The article of footwear according to claim 7, wherein the upper comprises a base layer that forms an interior cavity configured to receive a foot, and wherein the base layer is disposed beneath an inner liner, wherein the one or more tensile elements include six tensile elements, and wherein a portion of each of the six tensile elements is fixedly attached to the inner liner of the upper.

10. The article of footwear according to claim 7, the fastening system further including at least a first loop, the first loop being disposed along a midfoot edge of the upper, and wherein the first tensile element and the second tensile element both extend through the first loop.

11. The article of footwear according to claim 7, wherein the fastening system further includes a second receptacle, and wherein the second receptacle is configured to receive a portion of the fastener.

12. The article of footwear according to claim 7, further comprising an ankle cinching system.

13. The article of footwear according to claim 7, wherein at least a portion of the fastener is fixedly attached to a surface of the upper.

14. The article of footwear according to claim 7, wherein the base axis is associated with a lateral axis, and wherein the lateral axis extends from a medial side of the article of footwear to a lateral side of the article of footwear.

15. The article of footwear according to claim 10, the fastening system further including a second loop, the second loop being disposed adjacent to the first loop, and wherein a third tensile element and a fourth tensile element both extend through the second loop.

16. An article of footwear, the article of footwear comprising:

an upper, a fastener, a receptacle, and a plurality of tensile elements;

the upper including a base axis, a first diagonal axis, and a second diagonal axis, wherein the base axis, the first diagonal axis, and the second diagonal axis are nonparallel;

the upper including a forefoot portion, a midfoot portion, a vamp portion, and an instep portion, a lateral side, and a medial side;

the upper including an open state and a closed state;

the fastener including a first portion, a second portion, and a third portion, the first, second, and third portions forming a continuous strap that extends from the medial side to the lateral side and from the lateral side to the medial side;

the first portion being secured to the upper on the medial side in the forefoot portion and being aligned along the first diagonal axis;

the second portion being aligned with the first diagonal axis in the closed state and extending across the vamp portion from the medial side in the forefoot portion to the lateral side in the midfoot portion, the third portion being aligned with the base axis in the closed state and extending from the lateral side in the midfoot portion to the medial side in the midfoot portion;

the first portion of the fastener being disposed nearer to the forefoot portion relative to both the second portion and the third portion in the closed state;

the receptacle being disposed along the instep portion and includes an upper region and a lower region, wherein the upper region of the receptacle is configured to engage with the third portion of the fastener;

the plurality of tensile elements extending from the lateral side of the upper in the forefoot portion to the medial side of the upper in the midfoot portion in alignment with the second diagonal axis, the plurality of tensile elements engaging with the lower region of the receptacle and being spaced further apart at a first area in the forefoot portion than at a second area in the midfoot portion; and wherein the plurality of tensile elements extend across the vamp portion from the lateral side in the forefoot portion to the medial side in the midfoot portion, and wherein the second portion of the fastener is disposed directly above the plurality of tensile elements such that the second portion of the fastener and the plurality of tensile elements cross one another.

17. The article of footwear according to claim 16, wherein the plurality of tensile elements includes six tensile elements.

18. The article of footwear according to claim 16, wherein an anchor element contacts the plurality of tensile elements, the anchor element comprising a stitched region extending across the plurality of tensile elements in a direction substantially aligned with the first diagonal axis, the anchor element being configured to fixedly attach a portion of each of the plurality of tensile elements to the upper.

19. The article of footwear according to claim 16, wherein the plurality of tensile elements include a first tensile elements and a second tensile element that each extend across the vamp portion of the upper, wherein the first tensile element and the second tensile element together comprises a single tensile strand.

20. The article of footwear according to claim 19, wherein the single tensile strand is joined to an interior of the receptacle.

21. The article of footwear according to claim 20, further comprising a loop, wherein the loop is joined to an edge of the upper in the midfoot portion, and wherein the first tensile element and the second tensile element both extends through the loop.

22. The article of footwear according to claim 19, wherein a distance between the first tensile elements and the second tensile element generally increases in a direction extending from the midfoot portion to the forefoot portion.

23. The article of footwear according to claim 16, wherein the base axis is associated with a lateral axis, and wherein the lateral axis extends from the medial side of the upper to the lateral side of the upper.

24. The article of footwear according to claim 1, wherein the lower region of the receptacle is a first loop that is attached to a midfoot edge on the medial side of the upper.

* * * * *